US009880480B2

(12) United States Patent
Omori et al.

(10) Patent No.: US 9,880,480 B2
(45) Date of Patent: Jan. 30, 2018

(54) ELECTROSTATIC CHARGE IMAGE DEVELOPING TONER, ELECTROSTATIC CHARGE IMAGE DEVELOPER, AND TONER CARTRIDGE

(71) Applicant: FUJI XEROX CO., LTD., Tokyo (JP)

(72) Inventors: Hiroki Omori, Kanagawa (JP); Mona Tasaki, Kanagawa (JP); Yuka Yamagishi, Kanagawa (JP); Yutaka Saito, Kanagawa (JP); Fusako Kiyono, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/206,931

(22) Filed: Jul. 11, 2016

(65) Prior Publication Data

US 2017/0219947 A1 Aug. 3, 2017

(30) Foreign Application Priority Data

Jan. 28, 2016 (JP) ..... 2016-014467

(51) Int. Cl.

| | |
|---|---|
| ***G03G 9/08*** | (2006.01) |
| ***G03G 9/097*** | (2006.01) |
| ***G03G 15/08*** | (2006.01) |
| ***G03G 9/087*** | (2006.01) |

(52) U.S. Cl.
CPC ..... *G03G 9/09791* (2013.01); *G03G 9/0819* (2013.01); *G03G 9/0825* (2013.01); *G03G 9/0827* (2013.01); *G03G 9/08755* (2013.01); *G03G 15/0865* (2013.01)

(58) Field of Classification Search
CPC ..... G03G 9/09791; G03G 15/0865; G03G 9/0827; G03G 9/0825; G03G 9/08755; G03G 9/0819
See application file for complete search history.

(56) References Cited

U.S. PATENT DOCUMENTS 8,795,938 B2 8/2014 Uchinokura et al.

FOREIGN PATENT DOCUMENTS

JP 2013-156430 A 8/2013
JP 2013-156489 A 8/2013

*Primary Examiner* — Thorl Chea
(74) *Attorney, Agent, or Firm* — Oliff PLC

(57) ABSTRACT

An electrostatic charge image developing toner includes toner particles containing a binder resin and a release agent and an external additive containing fatty acid metal salt particles and abrasive particles, wherein a ratio (B/A) of an isolation amount B of the abrasive particles isolated from the toner particles after an ultrasonic isolation treatment to an isolation amount A of the fatty acid metal salt particles isolated from the toner particles after the ultrasonic isolation treatment is from 0.3 to 2.0.

18 Claims, 4 Drawing Sheets

ELECTROSTATIC CHARGE IMAGE DEVELOPING TONER, ELECTROSTATIC CHARGE IMAGE DEVELOPER, AND TONER CARTRIDGE

CROSS-REFERENCE TO RELATED APPLICATIONS

This application is based on and claims priority under 35 USC 119 from Japanese Patent Application No. 2016-014467 filed Jan. 28, 2016.

BACKGROUND

1. Technical Field

The present invention relates to an electrostatic charge image developing toner, an electrostatic charge image developer, and a toner cartridge.

2. Related Art

Methods of visualizing image information through an electrostatic charge image by an electrophotographic method or the like are currently used in various fields. In the electrophotographic method, image information is formed as an electrostatic charge image on a surface of an image holding member through a charging step and an exposure step, and a toner image is developed on the surface of the image holding member using a developer containing a toner. The toner image is visualized as an image through a transfer step of transferring the toner image onto a recording medium and a fixing step of fixing the toner image to a surface of the recording medium.

SUMMARY

According to an aspect of the invention, there is provided an electrostatic charge image developing toner including:

toner particles containing a binder resin and a release agent; and an external additive containing fatty acid metal salt particles and abrasive particles, wherein a ratio (B/A) of an isolation amount B of the abrasive particles isolated from the toner particles after an ultrasonic isolation treatment to an isolation amount A of the fatty acid metal salt particles isolated from the toner particles after the ultrasonic isolation treatment is from 0.3 to 2.0.

BRIEF DESCRIPTION OF THE DRAWINGS

Exemplary embodiments of the present invention will be described in detail based on the following figures, wherein.

DETAILED DESCRIPTION

Figure 1:
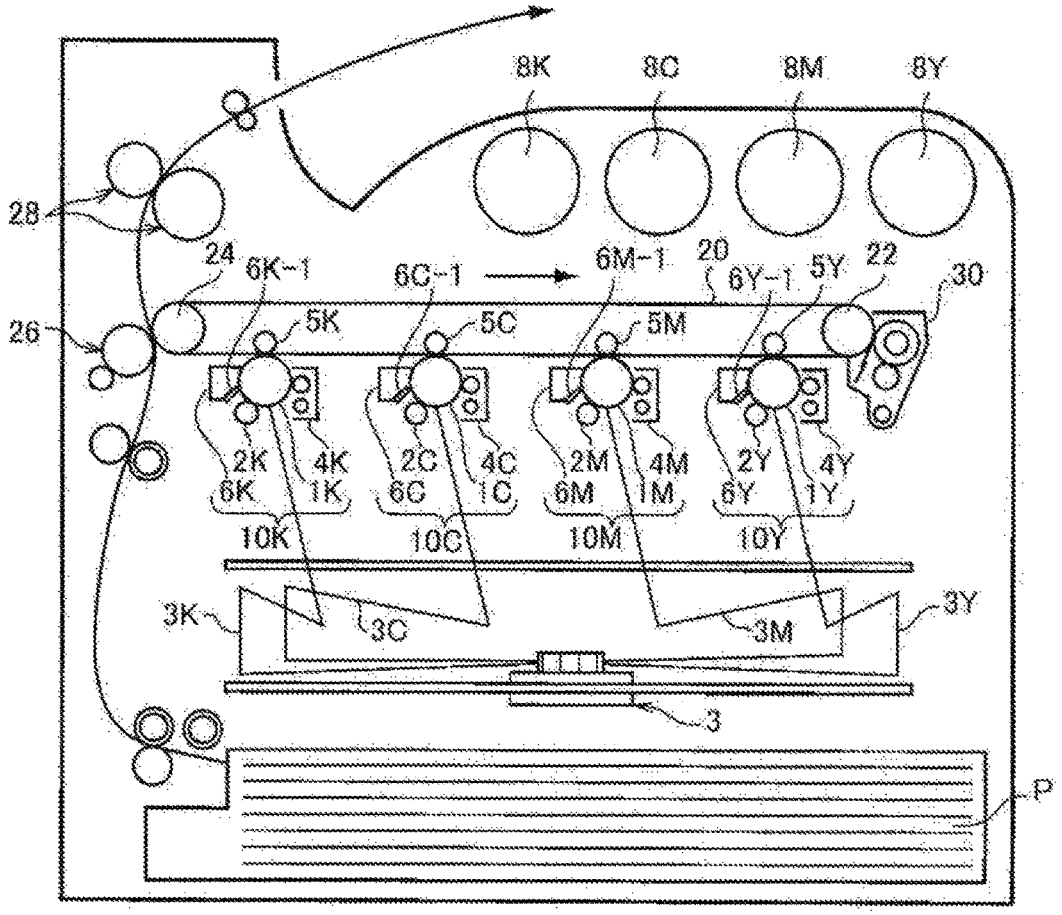
FIG. 1 is a configuration diagram of an example of an image forming apparatus according to an exemplary embodiment.

Hereinafter, an exemplary embodiment as an example of the invention will be described in detail.

Electrostatic Charge Image Developing Toner

An electrostatic charge image developing toner according to an exemplary embodiment (hereinafter, also simply referred to as "toner") has toner particles containing a binder resin and a release agent and an external additive containing fatty acid metal salt particles and abrasive particles. A ratio (B/A) of an isolation amount B of the abrasive particles separated from the toner particles after an ultrasonic isolation treatment to an isolation amount A of the fatty acid metal salt particles isolated from the toner particles after the ultrasonic isolation treatment (hereinafter, also referred to as an isolation amount ratio (B/A)) is from 0.3 to 2.0.

Since the toner according to this exemplary embodiment has the above-described configuration, a reduction in the concentration of an image formed in an area as a non-image portion in the preceding image formation cycle (that is, in an area as a non-image portion in an image formed in the preceding image formation cycle, another image as an image portion formed in the next image formation cycle) is prevented. The reason for this is not clear, but is thought to be due to the following reasons.

When an image is formed using an electrophotographic image forming apparatus provided with a cleaning unit having a cleaning blade, a toner remains on an image holding member after transfer of the toner image on the image holding member. When the residual toner reaches the cleaning blade, accumulated toner matter (toner dam) is formed, and cleaning properties are thus improved. The residual toner is scrapped off by the cleaning blade, and the surface of the image holding member is cleaned.

For example, in order to maintain stable cleaning properties, an image may be formed using a toner having toner particles and an external additive containing fatty acid metal salt particles. In a case in which an image is formed using this toner, cohesive power of accumulated toner matter is increased and toner dam is strengthened since the fatty acid metal salt particles are contained in the external additive. In addition, since the fatty acid metal salt particles are contained in the external additive, lubricity of the cleaning blade is increased.

Here, the fatty acid metal salt particles are likely to be present in a non-image portion on the image holding member. When an excessive amount of fatty acid metal salt particles is present in the non-image portion on the image holding member, the non-image portion may have too high lubricity. When the lubricity of the non-image portion is too high, the posture of the cleaning blade is easily changed, and thus cleaning properties are easy to decrease. In order to prevent this phenomenon, a toner having an external additive further containing abrasive particles in addition to the fatty acid metal salt particles may be used. In a case in which an image is formed using a toner having an external additive containing fatty acid metal salt particles and abrasive particles, the fatty acid metal salt particles and the abrasive particles also act to adjust, for example, the lubricity on a transfer medium (for example, intermediate transfer belt: an example of an intermediate transfer member) since the fatty acid metal salt particles and the abrasive particles travel together.

However, it is found that in a case in which an image is formed by, for example, an image apparatus provided with an intermediate transfer member using a toner having an external additive containing fatty acid metal salt particles and abrasive particles, a defective image (an image formed in an area as a non-image portion in the preceding image formation cycle) caused by defective transfer is easily caused. Regarding this phenomenon, the occurrence of a defective image caused by the defective transfer is particularly notable when images are continuously formed under a low-temperature and low-humidity environment (for example, temperature: 10° C., humidity: 15% RH).

In the toner having an external additive containing fatty acid metal salt particles and abrasive particles, in a case in which an isolation amount of the fatty acid metal salt particles is much larger than that of the abrasive particles, the amount of the fatty acid metal salt particles present in a non-image portion on an image holding member is easy to increase. In addition, in a case in which the non-image portion on the image holding member contacts with an intermediate transfer member when a toner image on the image holding member is transferred onto the intermediate transfer member, the fatty acid metal salt particles present in the non-image portion are moved to an area corresponding to the non-image portion on the intermediate transfer member. Therefore, the amount of the fatty acid metal salt particles present in the area corresponding to the non-image portion on the intermediate transfer member is increased, and thus release properties are increased in the area corresponding to the non-image portion on the intermediate transfer member. Thereafter, in a case in which another image as an image portion in the next image formation cycle is formed in the area as the non-image part, when the toner image on the image holding member is transferred onto the intermediate transfer member (primary transfer), the toner image is rarely transferred due to the increased release properties in the area corresponding to the non-image portion on the intermediate transfer member, and thus defective transfer of the toner image is easy to occur. As a result, the concentration of another image as an image portion formed in the next image formation cycle is easy to decrease in the area as a non-image portion in the preceding image formation cycle.

In a case in which an isolation amount of the abrasive particles is much larger than that of the fatty acid metal salt particles, the amount of the abrasive particles present in a non-image portion on an image holding member is increased. In addition, in a case in which the non-image portion on the image holding member contacts with an intermediate transfer member when a toner image on the image holding member is transferred onto the intermediate transfer member, the abrasive particles present in the non-image portion are moved to an area corresponding to the non-image portion on the intermediate transfer member. Therefore, the amount of the abrasive particles present in the area corresponding to the non-image portion on the intermediate transfer member is increased, and thus adhesive properties between the intermediate transfer member and the toner image are increased in the area corresponding to the non-image portion on the intermediate transfer member. Thereafter, in a case in which another image as an image portion in the next image formation cycle is formed in the area as the non-image part, the toner image after transfer of the toner image on the image holding member onto the intermediate transfer member is rarely transferred due to the increased adhesive properties with the intermediate transfer member when being transferred onto a recording medium (secondary transfer), and thus defective transfer easily occurs. As a result, the concentration of another image as an image portion formed in the next image formation cycle is easy to decrease in the area as a non-image portion in the preceding image formation cycle.

Since the isolation amount ratio (B/A) is from 0.3 to 2.0 in the toner of this exemplary embodiment, an excessive increase in the amount of the fatty acid metal salt particles or the abrasive particles moved to the intermediate transfer member from the area corresponding to the non-image portion on the image holding member is thought to be easily prevented. Therefore, appropriate release properties are easily maintained in the area corresponding to the non-image portion on the intermediate transfer member. In a case in which another image as an image portion is formed in the area as the non-image portion on the intermediate transfer member in the next image formation cycle, the occurrence of defective transfer when the toner image on the image holding member is transferred onto the intermediate transfer member and the occurrence of defective transfer when the toner image on the transfer belt is transferred onto a recording medium are prevented. As a result, a reduction in the concentration of the image formed in the area as a non-image portion in the preceding image formation cycle, occurring in association with the defective transfer, is thought to be prevented.

Since the toner according to this exemplary embodiment has the above-described configuration, a reduction in the concentration of an image formed in an area as a non-image portion in the preceding image formation cycle is prevented. In addition, even when images are continuously formed under a low-temperature and low-humidity environment (for example, temperature: 10° C., humidity: 15% RH), a reduction in the concentration of an image formed in an area as a non-image portion in the preceding image formation cycle is easily prevented.

Hereinafter, the toner according to this exemplary embodiment will be described in detail.

The toner according to this exemplary embodiment has toner particles and an external additive containing fatty acid metal salt particles and abrasive particles. If necessary, the external additive includes external additives other than the fatty acid metal salt particles and the abrasive particles.

Toner Particles

The toner particles contain, for example, a binder resin, a release agent, and if necessary, a colorant and other additives.

Binder Resin

Examples of the binder resin include vinyl resins formed of homopolymers of monomers such as styrenes (e.g., styrene, parachlorostyrene, and α-methyl styrene), (meth) acrylic esters (e.g., methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, and 2-ethylhexyl methacrylate), ethylenic unsaturated nitriles (e.g., acrylonitrile and methacrylonitrile), vinyl ethers (e.g., vinyl methyl ether and vinyl isobutyl ethyer), vinyl ketones (vinyl methyl ketone, vinyl ethyl ketone, and vinyl isopropenyl ketone), and olefins (e.g., ethylene, propylene, and butadiene), or copolymers obtained by combining two or more types of these monomers.

As the binder resin, there are also exemplified non-vinyl resins such as epoxy resins, polyester resins, polyurethane resins, polyamide resins, cellulose resins, polyether resins, and modified rosin, mixtures thereof with the above-described vinyl resins, or graft polymers obtained by polymerizing a vinyl monomer with the coexistence of such non-vinyl resins.

These binder resins may be used alone or in combination of two or more types thereof.

A polyester resin is suitable as the binder resin.

Examples of the polyester resin include known polyester resins.

Examples of the polyester resin include a condensation polymer of a polyvalent carboxylic acid and a polyol. A commercially available product or a synthesized product may be used as the polyester resin.

Examples of the polyvalent carboxylic acid include aliphatic dicarboxylic acids (e.g., oxalic acid, malonic acid, maleic acid, fumaric acid, citraconic acid, itaconic acid, glutaconic acid, succinic acid, alkenyl succinic acid, adipic acid, and sebacic acid), alicyclic dicarboxylic acids (e.g., cyclohexanedicarboxylic acid), aromatic dicarboxylic acids (e.g., terephthalic acid, isophthalic acid, phthalic acid, and naphthalene dicarboxylic acid), anhydrides thereof, and lower alkyl esters (having, for example, from 1 to 5 carbon atoms) thereof. Among these, for example, aromatic dicarboxylic acids are preferable as the polyvalent carboxylic acid.

The polyvalent carboxylic acid may be used in combination with a tri- or higher-valent carboxylic acid employing a crosslinked structure or a branched structure, together with a dicarboxylic acid. Examples of the tri- or higher-valent carboxylic acid include trimellitic acid, pyromellitic acid, anhydrides thereof, and lower alkyl esters (having, for example, from 1 to 5 carbon atoms) thereof.

The polyvalent carboxylic acids may be used alone or in combination of two or more types thereof.

Examples of the polyol include aliphatic diols (e.g., ethylene glycol, diethylene glycol, triethylene glycol, propylene glycol, butanediol, hexanediol, and neopentyl glycol), alicyclic diols (e.g., cyclohexanediol, cyclohexanedimethanol, and hydrogenated bisphenol A), and aromatic diols (e.g., ethylene oxide adduct of bisphenol A and propylene oxide adduct of bisphenol A). Among these, for example, aromatic diols and alicyclic diols are preferable, and aromatic diols are more preferable as the polyol.

The polyol may be used in combination with a tri- or higher-valent polyol employing a crosslinked structure or a branched structure, together with a diol. Examples of the tri- or higher-valent polyol include glycerin, trimethylolpropane, and pentaerythritol.

The polyols may be used alone or in combination of two or more types thereof.

A glass transition temperature (Tg) of the polyester resin is preferably from 50° C. to 80° C., and more preferably from 50° C. to 65° C.

The glass transition temperature is obtained from a DSC curve obtained by differential scanning calorimetry (DSC). More specifically, the glass transition temperature is obtained from the "extrapolated glass transition onset temperature" described in the method of obtaining a glass transition temperature in the "testing methods for transition temperatures of plastics" in JIS K 7121-1987.

A weight average molecular weight (Mw) of the polyester resin is preferably from 5,000 to 1,000,000, and more preferably from 7,000 to 500,000.

A number average molecular weight (Mn) of the polyester resin is preferably from 2,000 to 100,000.

A molecular weight distribution Mw/Mn of the polyester resin is preferably from 1.5 to 100, and more preferably from 2 to 60.

The weight average molecular weight and the number average molecular weight are measured by gel permeation chromatography (GPC). The molecular weight measurement by GPC is performed using a GPC.HLC-8120 GPC manufactured by Tosoh Corporation as a measuring device, a TSKgel Super HM-M (15 cm) which is a column manufactured by Tosoh Corporation, and a THF solvent. The weight average molecular weight and the number average molecular weight are calculated using a molecular weight calibration curve plotted from a monodisperse polystyrene standard sample from the results of the above measurement.

A known preparation method is used to prepare the polyester resin. Specific examples thereof include a method of conducting a reaction at a polymerization temperature set to from 180° C. to 230° C. under reduced pressure if necessary in the reaction system, while removing water or an alcohol that is generated during condensation.

In a case in which monomers of the raw materials are not dissolved or compatibilized at a reaction temperature, a high-boiling-point solvent may be added as a solubilizing agent to dissolve the monomers. In this case, a polycondensation reaction is caused while distilling away the solubilizing agent. In a case in which a monomer having poor compatibility is present in a copolymerization reaction, the monomer having poor compatibility and an acid or an alcohol to be polycondensed with the monomer may be preliminarily condensed, and then polycondensed with the major component.

Here, as the polyester resin, a modified polyester resin is also exemplified other than the above-described unmodified polyester resin. The modified polyester resin is a polyester resin in which a polyester resin having a bonding group other than an ester bond and a resin component which is different from the polyester resin component are bonded via a covalent bond or an ionic bond. Examples of the modified polyester resin include a resin having an end modified by the reaction of an active hydrogen compound with a polyester resin in which a functional group such as an isocyanate group which reacts with an acid group or a hydroxyl group is introduced to an end.

As the modified polyester resin, a urea-modified polyester resin is particularly preferable. When a urea-modified polyester resin is contained as the binder resin, a reduction in the concentration of an image formed in an area as a non-image portion in the preceding image formation cycle is easily prevented. The reason for this is thought to be that due to the crosslinking and the chemical structure of the urea-modified polyester resin (specifically, physical characteristics of the resin by the crosslinking of the urea-modified polyester resin, and chemical characteristics in affinity between the bonding group having polarity and the fatty acid metal salt particles having polarity), the adhesion between the toner particles and the fatty acid metal salt particles and abrasive particles is easily improved, and the range of the ratio of the isolation amount of the abrasive particles to the isolation amount of the fatty acid metal salt particles is easily controlled. For this reason, the content of the urea-modified polyester resin is preferably from 5% by weight to 50% by weight, and more preferably from 7% by weight to 20% by weight with respect to the entire binder resin.

The urea-modified polyester resin is preferably obtained by the reaction (at least one of a crosslinking reaction and an elongation reaction) of a polyester resin (polyester prepolymer) having an isocyanate group and an amine compound. The urea-modified polyester resin may contain a urethane bond together with the urea bond.

Examples of the polyester prepolymer having an isocyanate group include a prepolymer which is obtained by the reaction of a polyvalent isocyanate compound with a polyester which is a polycondensate of a polyvalent carboxylic acid and a polyol and has active hydrogen. Examples of the group having active hydrogen of the polyester include a hydroxyl group (alcoholic hydroxyl group and phenolic hydroxyl group), an amino group, a carboxyl group, and a mercapto group. An alcoholic hydroxyl group is preferable.

In the polyester prepolymer having an isocyanate group, as the polyvalent carboxylic acid and the polyol, compounds similar to the polyvalent carboxylic acid and the polyol in the description of the polyester resin are exemplified.

Examples of the polyvalent isocyanate compound include aliphatic polyisocyanates (tetramethylene diisocyanate, hexamethylene diisocyanate, 2,6-diisocyanate methylcaproate, and the like); alicyclic polyisocyanates (isophorone diisocyanate, cyclohexylmethane diisocyanate, and the like); aromatic diisocyanates (tolylene diisocyanate, diphenylmethane diisocyanate, and the like); aromatic aliphatic diisocyanates ($\alpha,\alpha,\alpha',\alpha'$-tetramethyl xylylene diisocyanate and the like); isocyanurates; and blocked polyisocyanates in which the above-described polyisocyanates are blocked with a blocking agent such as a phenol derivative, oxime, or caprolactam.

The polyvalent isocyanate compounds may be used alone or in combination of two or more types thereof.

Regarding the proportion of the polyvalent isocyanate compound, an equivalent ratio ([NCO]/[OH]) of the isocyanate group [NCO] to the hydroxyl group [OH] of the polyester prepolymer having a hydroxyl group is preferably from 1/1 to 5/1, more preferably from 1.2/1 to 4/1, and even more preferably from 1.5/1 to 2.5/1. When [NCO]/[OH] is from 1/1 to 5/1, a reduction in the concentration of an image formed in an area as a non-image portion in the preceding image formation cycle is more easily prevented. When [NCO]/[OH] is 5 or less, a reduction in the low-temperature fixability is easily prevented.

The content of the component derived from the polyvalent isocyanate compound in the polyester prepolymer having an isocyanate group is preferably from 0.5% by weight to 40% by weight, more preferably from 1% by weight to 30% by weight, and even more preferably from 2% by weight to 20% by weight with respect to the entire polyester prepolymers having an isocyanate group. When the content of the component derived from the polyvalent isocyanate is from 0.5% by weight to 40% by weight, a reduction in the concentration of an image formed in an area as a non-image portion in the preceding image formation cycle is more easily prevented. When the content of the component derived from the polyvalent isocyanate is 40% by weight or less, a reduction in the low-temperature fixability is easily prevented.

The number of isocyanate groups contained in a molecule of the polyester prepolymer having an isocyanate group is preferably 1 or more on average, more preferably from 1.5 to 3 on average, and even more preferably from 1.8 to 2.5 on average. When the number of isocyanate groups is 1 or more in a molecule, the molecular weight of the urea-modified polyester resin after the reaction increases, and a reduction in the concentration of an image formed in an area as a non-image portion in the preceding image formation cycle is more easily prevented.

Examples of the amine compound which reacts with the polyester prepolymer having an isocyanate group include diamine, tri- or higher-valent polyamine, amino alcohol, amino mercaptan, amino acid, and compounds in which the amino group of these amines is blocked.

Examples of the diamine include aromatic diamines (phenylene diamine, diethyltoluene diamine, 4,4'-diaminodiphenyl methane, and the like); alicyclic diamines (4,4'-diamino-3,3'-dimethyldicyclohexyl methane, diaminecyclohexane, isophorone diamine, and the like); and aliphatic diamines (ethylene diamine, tetramethylene diamine, hexamethylene diamine, and the like).

Examples of the tri- or higher-valent polyamine include diethylene triamine and triethylene tetramine.

Examples of the amino alcohol include ethanol amine and hydroxyethylaniline.

Examples of the amino mercaptan include aminoethyl mercaptan and aminopropyl mercaptan.

Examples of the amino acid include amino propionic acid and amino caproic acid.

Examples of the compounds in which the amino group of these amines is blocked include ketimine compounds obtained from amine compounds such as diamine, tri- or higher-valent polyamine, amino alcohol, amino mercaptan, and amino acid and ketone compounds (acetone, methyl ethyl ketone, methyl isobutyl ketone, and the like), and oxazoline compounds.

Among these amine compounds, ketimine compounds are preferable.

The amine compounds may be used alone or in combination of two or more types thereof.

The urea-modified polyester resin may be a resin in which the molecular weight after the reaction is adjusted by adjusting a reaction (at least one of a crosslinking reaction and an elongation reaction) of a polyester resin (polyester prepolymer) having an isocyanate group and an amine compound with a stopping agent (hereinafter, also referred to as "crosslinking/elongation reaction stopping agent") which stops at least one of the crosslinking reaction and the elongation reaction.

Examples of the crosslinking/elongation reaction stopping agent include monoamines (diethyl amine, dibutyl amine, butyl amine, lauryl amine, and the like) and blocked amines (ketimine compounds) prepared by blocking the monoamines.

Regarding the proportion of the amine compound, an equivalent ratio ([NCO]/[NHx]) of the isocyanate group [NCO] in the polyester prepolymer having an isocyanate group to the amino group [NHx] in the amines is preferably from 1/2 to 2/1, more preferably from 1/1.5 to 1.5/1, and even more preferably from 1/1.2 to 1.2/1. When [NCO]/[NHx] is within the above range, the molecular weight of the urea-modified polyester resin after the reaction increases, and a reduction in the concentration of an image formed in an area as a non-image portion in the preceding image formation cycle is more easily prevented.

The glass transition temperature of the urea-modified polyester resin is preferably from 40° C. to 65° C., and more preferably from 45° C. to 60° C. The number average molecular weight (Mn) is preferably from 2,500 to 50,000, and more preferably from 2,500 to 30,000. The weight average molecular weight (Mw) is preferably from 10,000 to 500,000, and more preferably from 30,000 to 100,000.

The content of the binder resin is, for example, preferably from 40% by weight to 95% by weight, more preferably from 50% by weight to 90% by weight, and even more preferably from 60% by weight to 85% by weight with respect to the entire toner particles.

Colorant

Examples of the colorant include various pigments such as Carbon Black, Chrome Yellow, Hansa Yellow, Benzidine Yellow, Threne Yellow, Quinoline Yellow, Pigment Yellow, Permanent Orange GTR, Pyrazolone Orange, Vulcan Orange, Watchung Red, Permanent Red, Brilliant Carmine 3B, Brilliant Carmine 6B, Du Pont Oil Red, Pyrazolone Red, Lithol Red, Rhodamine B Lake, Lake Red C, Pigment Red, Rose Bengal, Aniline Blue, Ultramarine Blue, Calco Oil Blue, Methylene Blue Chloride, Phthalocyanine Blue, Pigment Blue, Phthalocyanine Green, and Malachite Green Oxalate; and various dyes such as acridine dyes, xanthene dyes, azo dyes, benzoquinone dyes, azine dyes, anthraquinone dyes, thioindigo dyes, dioxazine dyes, thiazine dyes, azomethine dyes, indigo dyes, phthalocyanine dyes, aniline black dyes, polymethine dyes, triphenylmethane dyes, diphenylmethane dyes, and thiazole dyes.

The colorants may be used alone or in combination of two or more types thereof.

As the colorant, a colorant subjected to a surface treatment may be used if necessary, and may be used in combination with a dispersant. In addition, plural types of colorants may be used in combination.

The content of the colorant is, for example, preferably from 1% by weight to 30% by weight, and more preferably from 3% by weight to 15% by weight with respect to the entire toner particles.

Release Agent

Examples of the release agent include hydrocarbon waxes; natural waxes such as carnauba wax, rice wax, and candelilla wax; synthetic or mineral/petroleum waxes such as montan wax; and ester waxes such as fatty acid esters and montanic acid esters. The release agent is not limited thereto.

The melting temperature of the release agent is preferably from 50° C. to 110° C., and more preferably from 60° C. to 100° C.

The melting temperature is obtained from the "melting peak temperature" described in the method of obtaining a melting temperature in the "testing methods for transition temperatures of plastics" in JIS K 7121-1987, from a DSC curve obtained by differential scanning calorimetry (DSC).

The content of the release agent is, for example, preferably from 1% by weight to 20% by weight, and more preferably from 5% by weight to 15% by weight with respect to the entire toner particles.

Other Additives

Examples of other additives include known additives such as a magnetic material, a charge-controlling agent, and an inorganic powder. The toner particles contain these additives as internal additives.

Characteristics of Toner Particles

The toner particles may have a single layer structure or a so-called core-shell structure composed of a core (core particle) and a coating layer (shell layer) that is coated on the core.

Here, toner particles having a core-shell structure are preferably composed of, for example, a core configured to contain a binder resin, and if necessary, other additives such as a colorant and a release agent, and a coating layer configured to contain a binder resin.

The volume average particle diameter (D50v) of the toner particles is preferably from 2 μm to 10 μm, and more preferably from 4 μm to 8 μm.

Various average particle diameters and various particle diameter distribution indices of the toner particles are measured using a COULTER MULTISIZER II (manufactured by Beckman Coulter, Inc.) with ISOTON-II (manufactured by Beckman Coulter, Inc.) as an electrolyte.

In the measurement, from 0.5 mg to 50 mg of a measurement sample is added to 2 ml of an aqueous solution of 5% surfactant (preferably sodium alkylbenzene sulfonate) as a dispersant. The obtained material is added to from 100 ml to 150 ml of an electrolyte.

The electrolyte in which the sample is suspended is subjected to a dispersion treatment using an ultrasonic disperser for 1 minute, and a particle diameter distribution of particles having a particle diameter of from 2 μm to 60 μm is measured by a COULTER MULTISIZER II using an aperture having an aperture diameter of 100 μm. 50,000 particles are sampled.

Cumulative distributions by volume and by number are drawn from the side of the smallest diameter with respect to particle diameter ranges (channels) separated based on the measured particle diameter distribution. The particle diameter when the cumulative percentage becomes 16% is defined as that corresponding to a volume particle diameter D16v and a number particle diameter D16p, while the particle diameter when the cumulative percentage becomes 50% is defined as that corresponding to a volume average particle diameter D50v and a cumulative number average particle diameter D50p. Furthermore, the particle diameter when the cumulative percentage becomes 84% is defined as that corresponding to a volume particle diameter D84v and a number particle diameter D84p.

Using these, a volume particle diameter distribution index (GSDv) is calculated as $(D84v/D16v)^{1/2}$, while a number particle diameter distribution index (GSDp) is calculated as $(D84p/D16p)^{1/2}$.

The average circularity of the toner particles is preferably from 0.88 to 0.98, and more preferably from 0.90 to 0.97.

The average circularity of the toner particles is measured by FPIA-3000 manufactured by Sysmex Corporation. In this device, a system which subjects toner particles dispersed in water or the like to measurement by a flowing image analysis method is employed. The suspension of the particles sucked up is introduced into a flat sheath flow cell, and a sample flow is formed by a sheath liquid. The particles during the passing are photographed by a CCD camera via an objective in the form of a still image by irradiating the sample flow with strobe light. The photographed particle image is subjected to a two-dimensional image treatment, and the circularity is thus calculated from the projected area and the perimeter. Regarding the circularity, at least 4,000 particles are subjected to the image analysis and a statistical treatment is performed to obtain an average circularity.

$$\text{Circularity}=\text{Equivalent Circle Diameter Perimeter}/\text{Perimeter}=[2\times(A\pi)^{1/2}]/PM \qquad \text{Formula:}$$

In the above formula, A indicates a projected area, and PM indicates a perimeter.

In the measurement, a HPF (high resolution) mode is used and the dilution ratio is 1.0. In the data analysis, the circularity analysis range is from 0.40 to 1.00 for removing noises of the measurement.

From the standpoint that a reduction in the concentration of an image formed in an area as a non-image portion in the preceding image formation cycle is more easily prevented, the toner particles have a sea-island structure having a sea portion containing the binder resin and an island portion containing the release agent (that is, the toner particles have a sea-island structure in which the release agent is present like islands in a continuous phase of the binder resin), a maximum frequent value in distribution of the following eccentricity B of the island portion is preferably from 0.71 to 1.00, and the skewness of the distribution of the eccentricity B is preferably from −1.10 to −0.50.

Here, the toner having the above-described characteristics will be described. The eccentricity B of the island portion containing the release agent (hereinafter, also referred to as "release agent domain") is an index indicating how far the centroid of the release agent domain is separated from the centroid of the toner particle. The eccentricity B shows that as the value thereof becomes greater, the release agent domain is present closer to the surface of the toner particle, and that as the value thereof becomes smaller, the release agent domain is present closer to the center of the toner particle. The maximum frequent value in the distribution of the eccentricity B indicates a portion where there are the greatest number of release agent domains in a radial direction of the toner particle. The skewness of the distribution of the eccentricity B indicates symmetry of the distribution. Specifically, the skewness of the distribution of the eccentricity B indicates a degree of the skirting of the distribution from the maximum frequent value. That is, the skewness of the distribution of the eccentricity B indicates to what extent the release agent domain is distributed in a radial direction of the toner particle from the portion where there are the greatest number of release agent domains.

Figure 4:
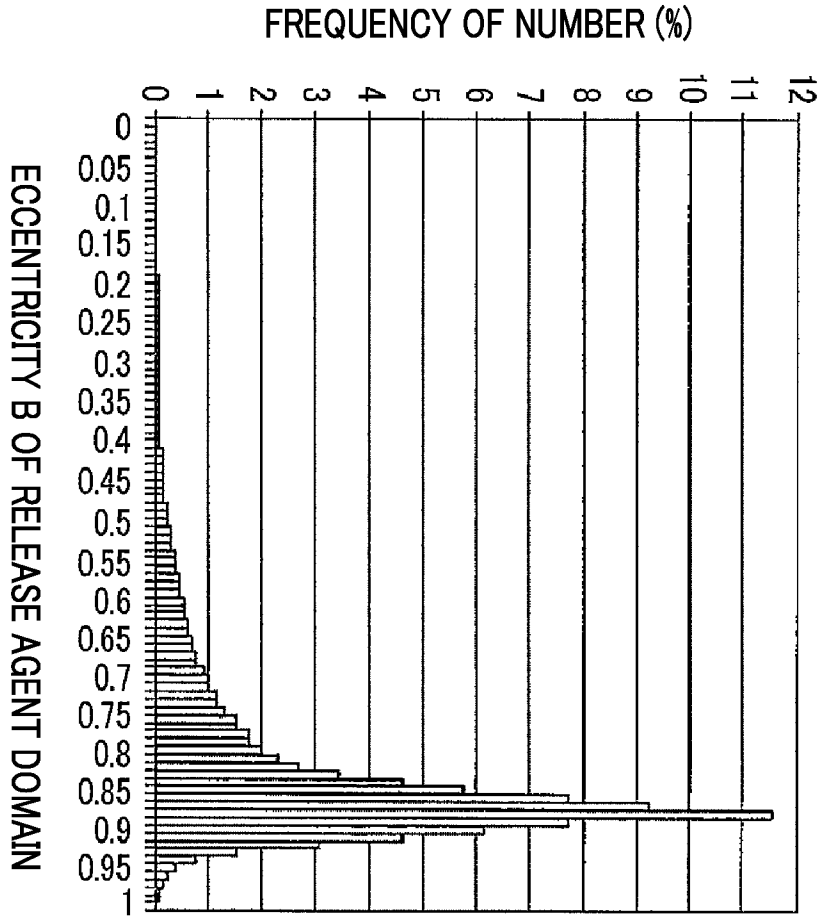
FIG. 4 is a diagram showing the distribution of an eccentricity B of a release agent domain in a toner according to an exemplary embodiment.

That is, when the maximum frequent value in the distribution of the eccentricity B of the release agent domain is within a range of from 0.71 to 1.00, this indicates that there are the greatest number of release agent domains in the surface layer portion of the toner particle. When the skewness of the distribution of the eccentricity B of the release agent domain is within a range of from −1.10 to −0.50, this indicates that the release agent domain is distributed with a gradient from the surface layer portion toward the inner portion of the toner particle (see FIG. 4).

The toner in which the maximum frequent value and the skewness of the distribution of the eccentricity B of the release agent domain satisfy the above ranges is a toner in which there are the greatest number of release agent domains in the surface layer part, and at the same time, the domains are distributed with a gradient from the inner portion toward the surface layer portion of the toner particle.

In the toner having the above-described characteristics, the surface layer portion has the largest amount of the release agent.

Accordingly, when the toner particles have the above characteristics, a reduction in the concentration of an image formed in an area as a non-image portion in the preceding image formation cycle is more easily prevented. The reason for this is not clear, but is presumed as follows. Since the release agent is present in the surface layer parts of the toner particles, affinity between the toner particles and the fatty acid metal salt particles increases, and thus the fatty acid metal salt particles easily adhere to the surfaces of the toner particles. As a result, the ratio of the isolation amount of the abrasive particles to the isolation amount of the fatty acid metal salt particles is thought to be easily controlled within the above-described range.

In the toner having a sea-island structure, a maximum frequent value in distribution of the following eccentricity B of the release agent domain (the island portion containing the release agent) is preferably from 0.75 to 0.95, more preferably from 0.80 to 0.95, and even more preferably from 0.85 to 0.90 from the standpoint that a reduction in the concentration of an image formed in an area as a non-image portion in the preceding image formation cycle is more easily prevented.

The skewness of the distribution of the eccentricity B of the release agent domain (the island portion containing the release agent) is from −1.10 to −0.50, and from the standpoint that a reduction in the concentration of an image formed in an area as a non-image portion in the preceding image formation cycle is more easily prevented, preferably from −1.00 to −0.60, and more preferably from −0.95 to −0.65.

Here, a method of confirming the sea-island structure of the toner particles will be described.

The sea-island structure of the toner particles is confirmed through, for example, a method of observing the cross-section of a toner particle by a transmission electron microscope, or a method of staining the cross-section of a toner particle with ruthenium tetroxide and observing the cross-section by a scanning electron microscope. From the standpoint that the release agent domain in the cross-section of the toner particle may be more clearly observed, a method of observing the cross-section by a scanning electron microscope is preferable. The scanning electron microscope is preferably a model well-known to those skilled in the art, and examples thereof include SU8020 manufactured by Hitachi High-Technologies Corporation, and JSM-7500F manufactured by JEOL Ltd.

Specifically, the observation method is as follows. First, a toner particle as a measurement target is embedded in an epoxy resin, and the epoxy resin is cured. The cured product is sectioned by a microtome equipped with a diamond blade to obtain an observation sample in which a cross-section of the toner particle is exposed. Staining with ruthenium tetroxide is applied to the observation sample slice, and the cross-section of the toner particle is observed with a scanning electron microscope. Through this observation method, a sea-island structure in which due to the difference in the staining degree, a release agent having a brightness difference (contrast) is present like islands in a continuous phase of a binder resin is observed in the cross-section of the toner particle.

A method of measuring the eccentricity B of the release agent domain will be described.

The eccentricity B of the release agent domain is measured as follows. First, using the sea-island confirmation method, an image is recorded at a magnification high enough to capture the cross-section of one toner particle in the visual field. The recorded image is analyzed under the condition of 0.010000 μm/pixel by using image analysis software (WinROOF manufactured by Mitani Corporation). By this image analysis, a cross-sectional shape of the toner particle is extracted with the aid of brightness difference (contrast) between the epoxy resin used for embedding and the binder resin of the toner particle. A projected area is obtained based on the extracted cross-sectional shape of the toner particle. An equivalent circle diameter is obtained from this projected area. The equivalent circle diameter is calculated by Formula: $2\sqrt{(\text{projected area}/\pi)}$. The obtained equivalent circle diameter is defined as an equivalent circle diameter D of the toner particle in the observation of the cross-section of the toner particle.

A centroid position is obtained based on the extracted cross-sectional shape of the toner particle. Subsequently, the shape of the release agent domain is extracted with the aid of brightness difference (contrast) between the binder resin and the release agent, and the centroid position of the release agent domain is obtained. Specifically, each of these centroid positions is obtained as a value obtained by assuming that with respect to the extracted region of the toner particle or release agent domain, the number of pixels in the region is n and xy-coordinates of each pixel are xi and yi (i=1, 2, . . . , n), and dividing the total of respective xi coordinate values by n for the x-coordinate of the centroid or dividing the total of respective yi coordinate values by n for the y-coordinate of the centroid. The distance between the centroid position of the cross-section of the toner particle and the centroid position of the release agent domain is then obtained. The obtained distance is defined as a distance d from the centroid of the toner particle to the centroid of the release agent-containing island portion in the observation of the cross-section of the toner particle.

Finally, from the equivalent circle diameter D and the distance d, the eccentricity B of the release agent domain is obtained by Expression (1): eccentricity B=2 d/D. The same operation as above is performed on each of plural release agent domains present in the cross-section of one toner particle, whereby the eccentricity B of the release agent domain is obtained.

Next, a method of calculating the maximum frequent value in the distribution of the eccentricity B of the release agent domain will be described.

First, the above-described measurement of the eccentricity B of the release agent domain is performed on 200 toner particles. The obtained data on the eccentricity B of each release agent domain is subjected to statistical and analytical processing for data segments in steps of 0.01 from 0 to obtain the distribution of the eccentricity B. The maximum frequent value in the obtained distribution, that is, the value of the data segment appearing most frequently in the distribution of the eccentricity B of the release agent domain is obtained. The value of this data segment is defined as the maximum frequent value in the distribution of the eccentricity B of the release agent domain.

Next, a method of calculating the skewness of the distribution of the eccentricity B of the release agent domain will be described.

First, the distribution of the eccentricity B of the release agent domain is obtained as described above. The skewness of the distribution of the eccentricity B is obtained according to the following expression. In the following formula, the skewness is Sk, the number of data on the eccentricity B of the release agent domain is n, the value of data on the eccentricity B of each release agent domain is xi (i=1, 2, . . . , n), the average value of the entire data on the eccentricity B of the release agent domain is x (x with a bar at the top), and the standard deviation of the entire data on the eccentricity B of the release agent domain is s.

$$Sk = \frac{n}{(n-1)(n-2)} \sum_{i=1}^{n} \left( \frac{x_i - \bar{x}}{s} \right)^3$$

A method of satisfying the distribution characteristics of the eccentricity B of the release agent domain in the toner particles will be described in a toner preparation method.

External Additive

Fatty Acid Metal Salt Particles

In this embodiment, the toner has fatty acid metal salt particles as the external additive. The fatty acid metal salt particles are particles of salt including a fatty acid and a metal.

The fatty acid may be either a saturated fatty acid or an unsaturated fatty acid. Regarding the number of carbon atoms of the fatty acid, a fatty acid having from 10 to 25 carbon atoms (preferably from 12 to 22 carbon atoms) is exemplified. The number of carbon atoms of the fatty acid includes carbon atoms of a carboxy group.

Specific examples of the fatty acid include saturated fatty acids such as behenic acid, stearic acid, palmitic acid, myristic acid, and lauric acid; and unsaturated fatty acids such as oleic acid, linoleic acid, and ricinoleic acid. Among these fatty acids, stearic acid and lauric acid are preferable, and stearic acid is more preferable.

As the metal, a divalent metal may be used. Specific examples of the metal include magnesium, calcium, aluminum, barium, and zinc. Among these, zinc is preferable.

Specific examples of the fatty acid metal salt particles include metal salts of stearic acid such as aluminum stearate, calcium stearate, potassium stearate, magnesium stearate, barium stearate, lithium stearate, zinc stearate, copper stearate, lead stearate, nickel stearate, strontium stearate, cobalt stearate, and sodium stearate; metal salts of palmitic acid such as zinc palmitate, cobalt palmitate, copper palmitate, magnesium palmitate, aluminum palmitate, and calcium palmitate; metal salts of lauric acid such as zinc laurate, manganese laurate, calcium laurate, iron laurate, magnesium laurate, and aluminum laurate; metal salts of oleic acid such as zinc oleate, manganese oleate, iron oleate, aluminum oleate, copper oleate, magnesium oleate, and calcium oleate; metal salts of linoleic acid such as zinc linoleate, cobalt linoleate, and calcium linoleate; and metal salts of ricinoleic acid such as zinc ricinoleate and aluminum ricinoleate.

Among these, as the fatty acid metal salt particles, particles of metal salts of stearic acid or metal salts of lauric acid are preferable, particles of zinc stearate or zinc laurate are more preferable, and zinc stearate particles are even more preferable in view of cleaning properties and material availability.

The method of preparing the fatty acid metal salt particles is not particularly limited, and examples thereof include a method of cationically substituting a fatty acid alkali metal salt; and a method of directly reacting a fatty acid and a metal hydroxide.

For examples, examples of the method of preparing zinc stearate particles as the fatty acid metal salt particles include a method of cationically substituting a sodium stearate; and a method of reacting a stearic acid and a zinc hydroxide.

The amount of the fatty acid metal salt particles to be externally added may be, for example, from 0.02 parts by weight to 5 parts by weight, and is preferably from 0.05 parts by weight to 3.0 parts by weight, and more preferably from 0.08 parts by weight to 1.0 part by weight with respect to 100 parts by weight of the toner particles.

Number Average Particle Diameter of Fatty Acid Metal Salt Particles

For the same reason, the number average particle diameter of the fatty acid metal salt particles may be, for example, from 0.1 μm to 10 μm (preferably from 0.3 μm to 6 μm).

The number average particle diameter of the fatty acid metal salt particles is a value measured by the following method.

First, a toner as a measurement target is observed by a scanning electron microscope (SEM). Equivalent circle diameters of 100 fatty acid metal salt particles as a measurement target are obtained by image analysis, and the equivalent circle diameter at a number accumulation of 50% (50-th particle) from the side of the smallest diameter in the distribution on the number basis is defined as the number average particle diameter.

In the image analysis for obtaining the equivalent circle diameters of 100 fatty acid metal salt particles as a measurement target, a two-dimensional image at a magnification of 10,000 times is photographed using an analyzer (ERA-8900: manufactured by Elionix Inc.), a projected area is obtained under the condition of 0.010000 μm/pixel by using image analysis software WinROOF (manufactured by Mitani Corporation), and the equivalent circle diameter is obtained by Formula: equivalent circle diameter=2√(projected area/π).

Particle Diameter Ratio Between Toner Particles and Fatty Acid Metal Salt Particles In the toner of this exemplary embodiment, when the volume average particle diameter of the toner particles is denoted by $D_a$, and the number average particle diameter of the fatty acid metal salt particles is denoted by $D_b$, a ratio ($D_a/D_b$) of the volume average particle diameter $D_a$ of the toner particles to the number average particle diameter $D_b$ of the fatty acid metal salt particles preferably satisfies $2.5 \leq D_a/D_b \leq 7$ (preferably $3.0 \leq D_a/D_b \leq 6.0$).

When this ratio ($D_a/D_b$) is within the above range, a reduction in the concentration of an image formed in an area as a non-image portion in the preceding image formation cycle is more easily prevented.

Abrasive Particles

The abrasive particles are not particularly limited.

From the standpoint that a reduction in the concentration of an image formed in an area as a non-image portion in the preceding image formation cycle is more easily prevented, the specific gravity of the abrasive particles may be 4.0 or greater (preferably from 6.0 to 7.0).

Specific examples of the abrasive particles include inorganic particles such as metal oxides, e.g., cerium oxide, magnesium oxide, aluminum oxide (alumina), zinc oxide, and zirconia; carbides, e.g., silicon carbide; nitrides, e.g., boron nitride; pyrophosphates, e.g., calcium pyrophosphate particles; carbonates, e.g., calcium carbonate and barium carbonate; and metal titanate particles, e.g., barium titanate, magnesium titanate, calcium titanate, and strontium titanate. The abrasive particles may be used alone or in combination of two or more types thereof. Among these, metal titanate particles are preferable as the abrasive particles, and in view of functions as the abrasive, availability, and cost, strontium titanate particles are more preferable.

Surfaces of the abrasive particles may be subjected to a hydrophobizing treatment with a hydrophobizing agent. Examples of the hydrophobizing agent include known organic silicon compounds having an alkyl group (e.g., methyl group, ethyl group, propyl group, and butyl group), and specific examples thereof include silazane compounds (e.g., silane compounds such as methyltrimethoxysilane, dimethyldimethoxysilane, trimethylchlorosilane, and trimethylmethoxysilane, hexamethyldisilazane, and tetramethyldisilazane). The hydrophobizing agents may be used alone or in combination of two or more types thereof.

The number average particle diameter of the abrasive particles is preferably from 2 μm to 10 μm, more preferably from 3 μm to 7 μm, and even more preferably from 4 μm to 6 μm from the standpoint that a reduction in the concentration of an image formed in an area as a non-image portion in the preceding image formation cycle is more easily prevented.

The number average particle diameter of the abrasive particles is a value measured by the following method.

First, a toner as a measurement target is added to a methanol, dispersed, and stirred. Then, the obtained material is treated in an ultrasonic bath, and thus fatty acid metal salt particles and abrasive particles may be separated from the toner. Ease of the separation is determined by the particle diameter and the specific gravity of the external additive, and since many abrasive particles having a large diameter and a high specific gravity are easily separated, the abrasive particles may be separated by setting weak ultrasonic treatment conditions, or by sedimentation by weak centrifugal separation of such a degree that a resin particle composition such as a toner does not sink. The separated abrasive particles are dried, and then observed by a scanning electron microscope (SEM). Equivalent circle diameters of 100 abrasive particles as a measurement target are obtained by image analysis, and the equivalent circle diameter at a number accumulation of 50% (50-th particle) from the side of the smallest diameter in the distribution on the number basis is defined as the number average particle diameter.

In the image analysis for obtaining the equivalent circle diameters of 100 abrasive particles as a measurement target, a two-dimensional image at a magnification of 10,000 times is photographed using an analyzer (ERA-8900: manufactured by Elionix Inc.), a projected area is obtained under the condition of 0.010000 μm/pixel by using image analysis software WinROOF (manufactured by Mitani Corporation), and the equivalent circle diameter is obtained by Formula: equivalent circle diameter$=2\sqrt{(\text{projected area}/\pi)}$.

The fatty acid metal salt particles and the abrasive particles may be distinguished from each other. The abrasive particles are distinguished by a sample collected through the separation method, and the fatty acid metal salt may be observed as particles by the observation through the method of observing the fatty acid metal salt particle diameter in the collected material obtained by drying the toner composition contained in the supernatant after the separation of the abrasive particles. The distinguishing method includes distinguishing by elemental mapping and is not particularly limited as long as distinguishing is possible.

The amount of the abrasive particles to be externally added may be from 0.01% by weight to 5% by weight, and is preferably from 0.02% by weight to 2% by weight, more preferably from 0.05% by weight to 1.5% by weight, and even more preferably from 0.1% by weight to 1% by weight with respect to the toner particles from the standpoint that a reduction in the concentration of an image formed in an area as a non-image portion in the preceding image formation cycle is more easily prevented.

Total Amount Ratio Between Abrasive Particles to Content of Fatty Acid Metal Salt Particles A ratio (D/C) of a total amount D of the abrasive particles to a total amount C of the fatty acid metal salt particles contained in the external additive may be $0.25 \leq D/C \leq 0.9$ (preferably $0.30 \leq D/C \leq 0.80$, and more preferably $0.35 \leq D/C \leq 0.75$) from the standpoint that a reduction in the concentration of an image formed in an area as a non-image portion in the preceding image formation cycle is more easily prevented.

Particle Diameter Ratio Between Fatty Acid Metal Salt Particles and Abrasive Particles In the toner of this exemplary embodiment, when the number average particle diameter of the fatty acid metal salt particles is denoted by $D_b$, and the number average particle diameter of the abrasive particles is denoted by $D_c$, a ratio ($D_c/D_b$) of the number average particle diameter $D_c$ of the abrasive particles to the number average particle diameter $D_b$ of the fatty acid metal salt particles preferably satisfies $0.1 \leq D_c/D_b \leq 16.7$. The ratio ($D_c/D_b$) more preferably satisfies $1.0 \leq D_c/D_b \leq 8.0$, and even more preferably satisfies $1.5 \leq D_c/D_b \leq 6.0$.

When this ratio ($D_c/D_b$) is within the above range, a reduction in the concentration of an image formed in an area as a non-image portion in the preceding image formation cycle is more easily prevented.

Isolation Amount Ratio Between Abrasive Particles and Fatty Acid Metal Salt Particles In the toner of this exemplary embodiment, the isolation amount ratio (B/A) is $0.3 \leq B/A \leq 2.0$. When the isolation amount ratio (B/A) is within the above range, a reduction in the concentration of an image formed in an area as a non-image portion in the preceding image formation cycle is prevented.

The isolation amount ratio (B/A) preferably satisfies $0.3 \leq B/A \leq 1.5$, more preferably satisfies $0.32 \leq B/A \leq 1.2$, and even more preferably satisfies $0.35 \leq B/A \leq 1.0$ from the standpoint that a reduction in the concentration of an image formed in an area as a non-image portion in the preceding image formation cycle is more easily prevented.

The isolation amount ratio (B/A) is a value obtained by measuring an isolation amount of the fatty acid metal salt particles and an isolation amount of the abrasive particles, which are obtained by the following method, and dividing the isolation amount A of the fatty acid metal salt particles by the isolation amount B of the abrasive particles.

The isolation amount of the fatty acid metal salt particles and the isolation amount of the abrasive particles are values obtained by subjecting the toner to an isolation treatment which is performed by applying ultrasonic waves. Specifically, the isolation amounts are values obtained by a method to be described later.

The isolation amount of the fatty acid metal salt particles include fatty acid metal salt particles isolated from the toner particles in the toner before the ultrasonic treatment (untreated), and fatty acid metal salt particles isolated by an ultrasonic isolation treatment to be described later. This is the same in the case of the isolation amount of the abrasive particles.

The isolation amount A of the fatty acid metal salt particles may be from 3.0 mg to 20 mg from the standpoint that a reduction in the concentration of an image formed in an area as a non-image portion in the preceding image formation cycle is more easily prevented. For the same reason, the isolation amount B of the abrasive particles may be from 3.0 mg to 20 mg.

The isolation rate of the fatty acid metal salt particles may be from 30% to less than 90% (preferably from 35% to less than 90%, more preferably from 35% to not more than 80%, and even more preferably from 40% to not more than 70%).

When the isolation rate of the fatty acid metal salt particles is 30% or higher, an excessive increase in the amount of the fatty acid metal salt particles present in an image portion on an image holding member is easily prevented. Therefore, a reduction in the adhesive properties between the toner image on the image holding member and a transfer medium (e.g., intermediate transfer belt) is easily prevented (that is, a reduction in the transfer properties of the toner image to the transfer medium is easily prevented). In addition, the occurrence of defective transfer when the toner image of the image holding member is transferred onto the transfer medium is easily prevented. As a result, a reduction in the concentration of the image portion is easily prevented.

When the isolation rate of the fatty acid metal salt particles is less than 90%, an excessive increase in the amount of the fatty acid metal salt particles present in a non-image portion on an image holding member is easily prevented. Accordingly, the amount of the fatty acid metal salt particles present in the non-image portion on the image holding member is easily prevented from being moved to a transfer medium. Therefore, a reduction in the adhesive properties with the toner image is easily prevented in an area corresponding to the non-image portion on the transfer medium. In addition, in a case in which an image as an image portion is formed in the area as the non-image portion in the next image formation cycle, the occurrence of defective transfer of the toner image when the toner image is transferred from the image holding member to the transfer medium is easily prevented. As a result, a reduction in the concentration of the image formed in the area as the non-image portion in the preceding image formation cycle is more easily prevented.

Ultrasonic Isolation Treatment for Fatty Acid Metal Salt Particles 2 g of a toner as a measurement target is added and dispersed in 40 ml of an aqueous solution of a 0.2% surfactant (polyoxyethylene (10) octylphenyl ether with a polyoxyethylene polymerization degree of 10). After the dispersion, an ultrasonic vibration having an output of 20 W and a frequency of 20 kHz is applied for 1 minute using an ultrasonic homogenizer (US300T manufactured by Nissei Corporation) to separate an external additive from toner particles. Thereafter, the dispersion is put into a sedimentation tube-attached high-speed centrifugal separator of 50 ml (Model: M160 IV manufactured by Sakuma Seisakusho) to separate the toner particles by sedimentation at 3,000 rpm for 7 minutes, the supernatant is sequentially filtered using membrane filters (FHLP02500 and GSEP047S0 manufactured by Millipore Corporation) having a pore diameter of 5 μm and a pore diameter of 0.22 μm, respectively, and the filtrate is dried. A dry sample is obtained by repeating the above operation. 3 g of the obtained dry sample is formed into 40 mmφ pellets at a pressure of 10 t/cm$^2$ using a tablet forming machine, and is defined as Sample 1 (a sample after the ultrasonic isolation treatment for the fatty acid metal salt particles).

Ultrasonic Isolation Treatment for Abrasive Particles 2 g of a toner as a measurement target is added and sufficiently dispersed in 40 ml of an aqueous solution of a 0.2% surfactant (polyoxyethylene (10) octylphenyl ether with a polyoxyethylene polymerization degree of 10) such that the toner is wet with the aqueous solution. In this state, an ultrasonic vibration having an output of 20 W and a frequency of 20 kHz is applied for 1 minute using an ultrasonic homogenizer (US300T manufactured by Nissei Corporation) to separate an external additive from toner particles. Sodium polytungstate is added to this dispersion, and the specific gravity of the obtained material is adjusted to from 1.5 to 2.0. Then, this material is put into a sedimentation tube-attached high-speed centrifugal separator of 50 ml (Model: M160 IV manufactured by Sakuma Seisakusho) to perform centrifugal separation at 3,000 rpm for 7 minutes. Then, 60 mL of pure water is added to the toner in the upper layer to obtain a dispersion slurry, and suction filtration is performed (KIRIYAMA FUNNEL FILTER PAPER No. 5C, 60 φm/m, manufactured by Kiriyama Glass Co.). 60 mL of pure water is added to the toner remaining on the filter paper to obtain a dispersion slurry, and the dispersion slurry is subjected to suction filtration and washed. The toner remaining on the filter paper is collected and dried for 8 hours in a thermostatic bath at 40° C. A dry sample is obtained by repeating the above operation. 3 g of the obtained dry sample is formed into 40 mmφ pellets at a pressure of 10 t/cm$^2$ using a tablet forming machine, and is defined as a sample 2 (a sample after the ultrasonic isolation treatment for the abrasive particles).

3 g of a toner which is not subjected to the ultrasonic isolation treatment is formed into 40 mmφ pellets at a pressure of 10 t/cm$^2$ using a tablet forming machine, and is defined as an untreated sample.

Measurement of Each Isolation Amount

A metal element content of each sample is measured by a fluorescent X-ray device. The metal element content derived from the fatty acid metal salt particles and the metal element content derived from the abrasive particles are obtained by a calibration curve plotted preliminarily.

Thereafter, from the obtained result of the content of the metal contained in the fatty acid metal salt particles, an isolation amount of the fatty acid metal salt particles is obtained by the following Formula (A).

$$\text{Isolation Amount } (A) \text{ of Fatty Acid Metal Salt Particles} = C_{01} - C_1 \quad \text{Formula (A):}$$

(where $C_{01}$ indicates a metal element content of the fatty acid metal salt particles of the untreated sample, and $C_1$ indicates a metal element content of the fatty acid metal salt particles of Sample 1)

From the obtained result of the content of the metal contained in the abrasive particles, an isolation amount of the abrasive particles is obtained by the following Formula (B).

$$\text{Isolation Amount } (B) \text{ of Abrasive Particles} = C_{O2} - C_2 \quad \text{Formula (B):}$$

(where $C_{02}$ indicates a metal element content of the abrasive particles of the untreated sample, and $C_2$ indicates a metal element content of the abrasive particles of Sample 2)

The isolation rate of the fatty acid metal salt is obtained by the following Formula (C).

$$\text{Isolation Rate of Fatty Acid Metal Salt Particles} = \{(C_{01} - C_1)/C_{01}\} \times 100 \quad \text{Formula (C):}$$

Other External Additives

An external additive other than the fatty acid metal salt particles may be externally added to the toner. Examples of the external additive include inorganic particles. Examples of the inorganic particles include $SiO_2$, $TiO_2$, CuO, $SnO_2$, $Fe_2O_3$, BaO, CaO, $K_2O$, $Na_2O$, CaO—$SiO_2$, $Al_2O_3.2SiO_2$, $BaSO_4$, and $MgSO_4$.

Surfaces of the inorganic particles used as an external additive are preferably subjected to a hydrophobizing treatment. The hydrophobizing treatment is performed by, for example, dipping the inorganic particles in a hydrophobizing agent. The hydrophobizing agent is not particularly limited, and examples thereof include silane coupling agents, silicone oil, titanate coupling agents, and aluminum coupling agents. These may be used alone or in combination of two or more types thereof.

Generally, the amount of the hydrophobizing agent is, for example, from 1 part by weight to 10 parts by weight with respect to 100 parts by weight of the inorganic particles.

Examples of the external additive also include resin particles (resin particles such as polystyrene, polymethylmethacrylate (PMMA), and melamine resin) and a cleaning aid (e.g., fluorine polymer particles).

The amount of the external additive to be externally added is, for example, preferably from 0.01% by weight to 5% by weight, and more preferably from 0.01% by weight to 2.0% by weight with respect to the toner particles.

Toner Preparation Method

Next, a toner preparation method according to this exemplary embodiment will be described.

The toner according to this exemplary embodiment is obtained by externally adding an external additive containing fatty acid metal salt particles and abrasive particles to toner particles after preparation of the toner particles.

The toner particles may be prepared by any of a dry method (e.g., kneading and pulverizing method) and a wet method (e.g., aggregation and coalescence method, suspension and polymerization method, and dissolution and suspension method). The toner particle preparation method is not particularly limited to these methods, and a known preparation method is employed.

Specifically, for example, in a case in which the toner particles are prepared by an aggregation and coalescence method, the toner particles are prepared through the steps of: preparing a resin particle dispersion in which resin particles as a binder resin are dispersed (resin particle dispersion preparation step), aggregating the resin particles (if necessary, other particles) in the resin particle dispersion (if necessary, in the dispersion after mixing with other particle dispersions) to form aggregated particles (aggregated particle forming step), and heating the aggregated particle dispersion in which the aggregated particles are dispersed, to coalesce the aggregated particles, thereby forming toner particles (coalescence step).

Particularly, in a case in which a toner (toner particles) satisfying the above-described distribution characteristics of the eccentricity B of the release agent domain is prepared, the toner particles are preferably prepared by the following aggregation and coalescence method.

In the following aggregation and coalescence method, a method of preparing a toner (toner particles) also containing a colorant will be described. However, the colorant is an additive contained in the toner particles if necessary.

Specifically, the toner particles are preferably prepared through the steps of:

preparing dispersions (dispersion preparation step);

forming first aggregated particles by aggregating particles in a dispersion obtained by mixing a first resin particle dispersion in which first resin particles as a binder resin are dispersed with a colorant particle dispersion in which particles of a colorant (hereinafter, also referred to as "colorant particles") are dispersed (first aggregated particle forming step);

sequentially adding, after obtaining a first aggregated particle dispersion in which the first aggregated particles are dispersed, a mixed dispersion in which second resin particles as a binder resin and particles of a release agent (hereinafter, also referred to as "release agent particles") are dispersed to the first aggregated particle dispersion, while slowly increasing the concentration of the release agent particles in the mixed dispersion to further aggregate the second resin particles and the release agent particles on surfaces of the first aggregated particles, thereby forming second aggregated particles (second aggregated particle forming step);

further mixing, after obtaining a second aggregated particle dispersion in which the second aggregated particles are dispersed, the second aggregated particle dispersion with a third resin particle dispersion in which third resin particles as a binder resin are dispersed to further aggregate the third resin particles on surfaces of the second aggregated particles so as to adhere thereto, thereby forming third aggregated particles (third aggregated particle forming step); and heating a third aggregated particle dispersion in which the third aggregated particles are dispersed to coalesce the third aggregated particles, thereby forming toner particles (coalescence step).

The toner particle preparation method is not limited to the above methods. For example, particles are aggregated in a mixed dispersion obtained by mixing a resin particle dispersion with a colorant particle dispersion. Next, in the course of the aggregation, a release agent particle dispersion is added to the mixed dispersion while slowly increasing an addition rate or increasing the concentration of the release agent particles, and the aggregation of the respective particles is allowed to further proceed to form aggregated particles. Toner particles may be formed through the coalescence of the aggregated particles.

Hereinafter, the steps will be described in detail.

Step of Preparing Dispersions

First, dispersions to be used in the aggregation and coalescence method are prepared. Specifically, a first resin particle dispersion in which first resin particles as a binder resin are dispersed, a colorant particle dispersion in which colorant particles are dispersed, a second resin particle dispersion in which second resin particles as a binder resin are dispersed, a third resin particle dispersion in which third resin particles as a binder resin are dispersed, and a release particle dispersion in which release agent particles are dispersed are prepared.

In the step of preparing the dispersion, the first resin particles, the second resin particles, and the third resin particles will be referred to as "resin particles" for description.

Here, the resin particle dispersion is prepared by, for example, dispersing resin particles with a surfactant in a dispersion medium.

Examples of the dispersion medium which is used for the resin particle dispersion include aqueous mediums.

Examples of the aqueous mediums include water such as distilled water and ion exchange water, and alcohols. These may be used alone or in combination of two or more types thereof.

Examples of the surfactant include anionic surfactants such as sulfate, sulfonate, phosphate, and soap anionic surfactants; cationic surfactants such as amine salt and quaternary ammonium salt cationic surfactants; and nonionic surfactants such as polyethylene glycol, ethylene oxide adduct of alkyl phenol, and polyol nonionic surfactants. Among these, anionic surfactants and cationic surfactants are particularly preferable. Nonionic surfactants may be used in combination with anionic surfactants or cationic surfactants.

The surfactants may be used alone or in combination of two or more types thereof.

Regarding the resin particle dispersion, as a method of dispersing the resin particles in the dispersion medium, for example, common dispersing methods using, for example, a rotary shearing-type homogenizer, a ball mill having media, a sand mill, and a Dyno mill are exemplified. Depending on the type of the resin particles, resin particles may be dispersed in the resin particle dispersion using, for example, a phase inversion emulsification method.

The phase inversion emulsification method includes: dissolving a resin to be dispersed in a hydrophobic organic solvent in which the resin is soluble; conducting neutralization by adding abase to an organic continuous phase (O phase); converting the resin (so-called phase inversion) from W/O to O/W by adding an aqueous medium (W phase) to form a discontinuous phase, thereby dispersing the resin as particles in the aqueous medium.

The volume average particle diameter of the resin particles dispersed in the resin particle dispersion is, for example, preferably from 0.01 μm to 1 μm, more preferably from 0.08 μm to 0.8 μm, and even more preferably from 0.1 μm to 0.6 μm.

Regarding the volume average particle diameter of the resin particles, a cumulative distribution by volume is drawn from the side of the smallest diameter with respect to particle diameter ranges (channels) separated using the particle diameter distribution obtained by the measurement with a laser diffraction-type particle diameter distribution measuring device (for example, manufactured by Horiba, Ltd., LA-700), and the particle diameter when the cumulative percentage becomes 50% with respect to the entire particles is measured as a volume average particle diameter D50v. The volume average particle diameter of the particles in other dispersions is also measured in the same manner.

The content of the resin particles contained in the resin particle dispersion is, for example, preferably from 5% by weight to 50% by weight, and more preferably from 10% by weight to 40% by weight.

For example, the colorant particle dispersion and the release agent particle dispersion are also prepared in the same manner as in the case of the resin particle dispersion. That is, the particles in the resin particle dispersion are the same as the colorant particles dispersed in the colorant particle dispersion and the release agent particles dispersed in the release agent particle dispersion, in terms of the volume average particle diameter, the dispersion medium, the dispersing method, and the content of the particles.

First Aggregated Particle Forming Step

Next, the first resin particle dispersion and the colorant particle dispersion are mixed together.

In this mixed dispersion, the first resin particles and the colorant particles are heterogeneously aggregated to form first aggregated particles including the first resin particles and the colorant particles.

Specifically, for example, an aggregating agent is added to the mixed dispersion and a pH of the mixed dispersion is adjusted to acidic (for example, the pH is from 2 to 5). If necessary, a dispersion stabilizer is added. Then, the mixed dispersion is heated at a glass transition temperature of the first resin particles (specifically, for example, from a temperature lower than the glass transition temperature of the first resin particles by 30° C. to a temperature lower than the glass transition temperature by 10° C.) to aggregate the particles dispersed in the mixed dispersion, thereby forming the first aggregated particles.

In the first aggregated particle forming step, for example, the aggregating agent may be added at room temperature (for example, 25° C.) under stirring of the mixed dispersion using a rotary shearing-type homogenizer, the pH of the mixed dispersion may be adjusted to acidic (for example, the pH is from 2 to 5), a dispersion stabilizer may be added if necessary, and the heating may be then performed.

Examples of the aggregating agent include a surfactant having a polarity opposite to that of the surfactant which is used as the dispersant to be added to the mixed dispersion, such as inorganic metal salts and di- or higher-valent metal complexes. Particularly, in a case in which a metal complex is used as the aggregating agent, the amount of the surfactant to be used is reduced and charging characteristics are improved.

If necessary, an additive may be used which forms a complex or a similar bond with the metal ions of the aggregating agent. As this additive, a chelating agent is preferably used.

Examples of the inorganic metal salts include metal salts such as calcium chloride, calcium nitrate, barium chloride, magnesium chloride, zinc chloride, aluminum chloride, and aluminum sulfate, and inorganic metal salt polymers such as polyaluminum chloride, polyaluminum hydroxide, and calcium polysulfide.

A water-soluble chelating agent may be used as the chelating agent. Examples of the chelating agent include oxycarboxylic acids such as tartaric acid, citric acid, and gluconic acid, iminodiacetic acid (IDA), nitrilotriacetic acid (NTA), and ethylenediaminetetraacetic acid (EDTA).

The amount of the chelating agent to be added is, for example, preferably from 0.01 parts by weight to 5.0 parts by weight, and more preferably from 0.1 parts by weight to less than 3.0 parts by weight with respect to 100 parts by weight of the first resin particles.

Second Aggregated Particle Forming Step

Next, after obtaining a first aggregated particle dispersion in which the first aggregated particles are dispersed, a mixed dispersion in which second resin particles and release agent particles are dispersed is sequentially added to the first aggregated particle dispersion while slowly increasing the concentration of the release agent particles in the mixed dispersion.

The second resin particles may be the same type as or a different type from the first resin particles.

The second resin particles and the release agent particles are aggregated on surfaces of the first aggregated particles in the dispersion in which the first aggregated particles, the second resin particles, and the release agent particles are dispersed. Specifically, for example, in the first aggregated particle forming step, when the first aggregated particles reach a target particle diameter, the mixed dispersion in which the second resin particles and the release agent particles are dispersed is added to the first aggregated particle dispersion while slowly increasing the concentration of the release agent particles, and this dispersion is heated at a temperature that is equal to or lower than the glass transition temperature of the second resin particles.

Through this step, aggregated particles are formed in which the second resin particles and the release agent particles adhere to the surfaces of the first aggregated particles. That is, second aggregated particles in which aggregates of the second resin particles and the release agent particles adhere to the surfaces of the first aggregated particles are formed. At this time, since the mixed dispersion in which the second resin particles and the release agent particles are dispersed is sequentially added to the first aggregated particle dispersion while slowly increasing the concentration of the release agent particles, aggregates of the second resin particles and the release agent particles adhere to the surfaces of the first aggregated particles such that the concentration (existence rate) of the release agent particles slowly increases toward the outside in a radial direction of the particle.

Here, a power-feed addition method is preferably used as the method of adding the mixed dispersion. Using this power-feed addition method, it is possible to add the mixed dispersion to the first aggregated particle dispersion while slowly increasing the concentration of the release agent particles in the mixed dispersion.

Hereinafter, the method of adding the mixed dispersion using the power-feed addition method will be described with reference to the drawing.

Figure 3:
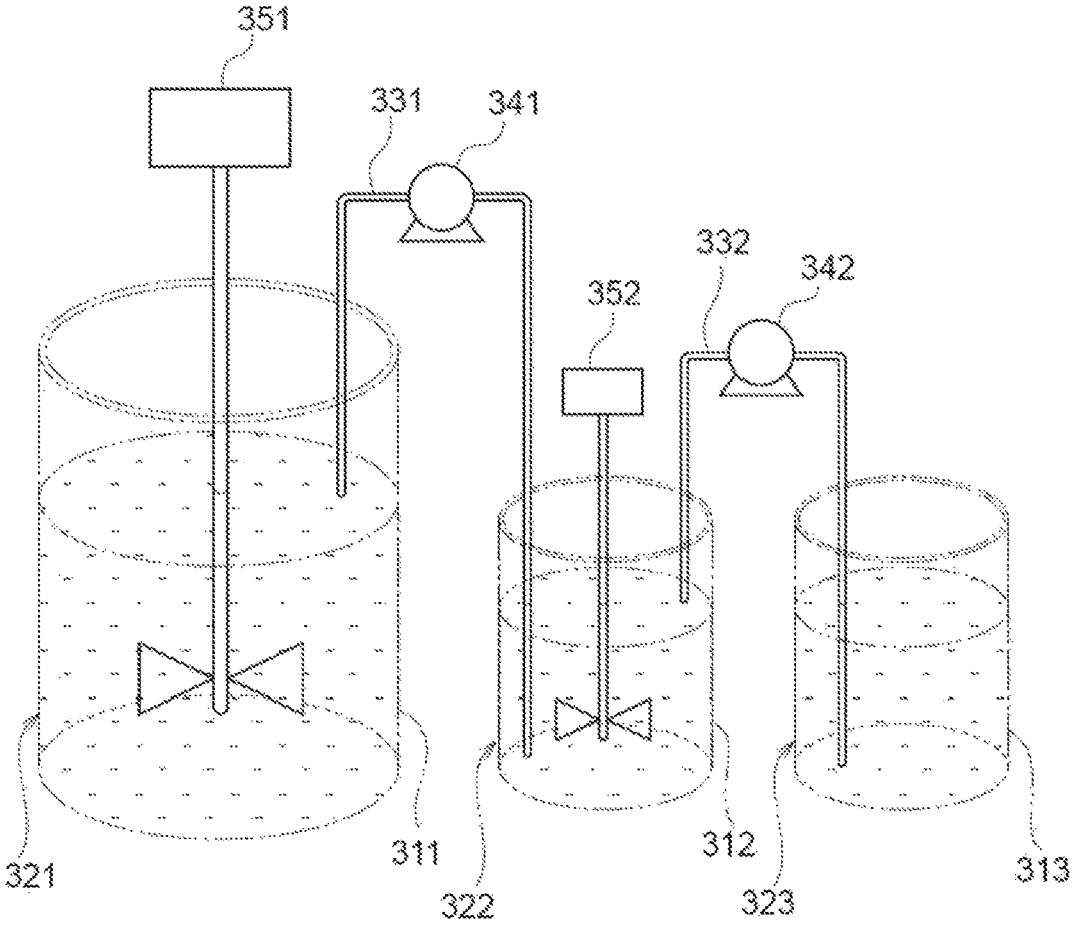
FIG. 3 is a schematic diagram for illustrating a power-feed addition method.

FIG. 3 shows an apparatus which is used in the power-feed addition method. In FIG. 3, the reference numeral 311 indicates a first aggregated particle dispersion, the reference numeral 312 indicates a second resin particle dispersion, and the reference numeral 313 indicates a release agent particle dispersion.

The apparatus shown in FIG. 3 has a first housing tank 321 which contains a first aggregated particle dispersion in which first aggregated particles are dispersed, a second housing tank 322 which contains a second resin particle dispersion in which second resin particles are dispersed, and a third housing tank 323 which contains a release agent particle dispersion in which release agent particles are dispersed.

The first housing tank 321 and the second housing tank 322 are connected by a first liquid supply tube 331. A first liquid supply pump 341 exists in the middle of the route of the first liquid supply tube 331. By drive of the first liquid supply pump 341, the dispersion contained in the second housing tank 322 is supplied to the dispersion contained in the first housing tank 321 through the first liquid supply tube 331.

A first stirrer 351 is disposed in the first housing tank 321. By drive of the first stirrer 351, the dispersions are stirred and mixed in the first housing tank 321 when the dispersion contained in the second housing tank 322 is supplied to the dispersion contained in the first housing tank 321.

The second housing tank 322 and the third housing tank 323 are connected by a second liquid supply tube 332. A second liquid supply pump 342 exists in the middle of the route of the second liquid supply tube 332. By drive of the second liquid supply pump 342, the dispersion contained in the third housing tank 323 is supplied to the dispersion contained in the second housing tank 322 through the second liquid supply tube 332.

A second stirrer 352 is disposed in the second housing tank 322. By drive of the second stirrer 352, the dispersions are stirred and mixed in the second housing tank 322 when the dispersion contained in the third housing tank 323 is supplied to the dispersion contained in the second housing tank 322.

In the apparatus shown in FIG. 3, first, the first aggregated particle forming step is performed in the first housing tank 321 to prepare the first aggregated particle dispersion, and the first aggregated particle dispersion is contained in the first housing tank 321. The first aggregated particle forming step may be performed in another tank to prepare the first aggregated particle dispersion, and the first aggregated particle dispersion may be contained in the first housing tank 321.

In this state, the first liquid supply pump 341 and the second liquid supply pump 342 are driven. By this drive, the second resin particle dispersion contained in the second housing tank 322 is supplied to the first aggregated particle dispersion contained in the first housing tank 321. In addition, by drive of the first stirrer 351, the dispersions are stirred and mixed in the first housing tank 321.

The release agent particle dispersion contained in the third housing tank 323 is supplied to the second resin particle dispersion contained in the second housing tank 322. In addition, by drive of the second stirrer 352, the dispersions are stirred and mixed in the second housing tank 322.

At this time, the release agent particle dispersion is sequentially supplied to the second resin particle dispersion contained in the second housing tank 322, and the concentration of the release agent particles slowly increases. Therefore, in the second housing tank 322, a mixed dispersion in which the second resin particles and the release agent particles are dispersed is contained, and this mixed dispersion is supplied to the first aggregated particle dispersion contained in the first housing tank 321. The supply of the mixed dispersion is continuously performed with an increase in the concentration of the release agent particle dispersion in the mixed dispersion.

Using the power-feed addition method, it is possible to add, to the first aggregated particle dispersion, the mixed dispersion in which the second resin particles and the release agent particles are dispersed, while slowly increasing the concentration of the release agent particles.

In the power-feed addition method, the distribution characteristics of the release agent domain of the toner are adjusted by adjusting liquid supply start times and liquid supply rates of the dispersions contained in the second housing tank 322 and the third housing tank 323. In addition, in the power-feed addition method, the distribution characteristics of the release agent domain of the toner are also adjusted by adjusting the liquid supply rate during the supply of the dispersions contained in the second housing tank 322 and the third housing tank 323.

Specifically, for example, the maximum frequent value in the distribution of the eccentricity B of the release agent domain is adjusted according to the time at which the supply of the release agent particle dispersion from the third housing tank 323 to the second housing tank 322 ends. More specifically, for example, when the supply of the release agent particle dispersion from the third housing tank 323 to the second housing tank 322 ends before the end of the supply from the second housing tank 322 to the first housing tank 321, the concentration of the release agent particles in the mixed dispersion in the second housing tank 322 does not increase after that time. Accordingly, the maximum frequent value in the distribution of the eccentricity B of the release agent domain is reduced.

The skewness of the distribution of the eccentricity B of the release agent domain is adjusted according to liquid supply times of the dispersions from the second housing tank 322 and the third housing tank 323 and liquid supply rates of the dispersions from the second housing tank 322 to the first housing tank 321. More specifically, for example, when a liquid supply rate of the dispersion from the second housing tank 322 is lowered by accelerating the liquid supply start time of the release agent particle dispersion from the third housing tank 323 and the liquid supply start time of the dispersion from the second housing tank 322, the release agent particles are arranged from the inner side of the particle to the outside in the aggregated particles to be formed. Accordingly, the skewness of the distribution of the eccentricity B of the release agent domain is increased.

The above-described power-feed addition method is not limited to the above method. For example, various methods may be employed, such as 1) a method in which a housing tank containing a second resin particle dispersion and a housing tank containing a mixed dispersion in which second resin particles and release agent particles are dispersed are separately provided, and each dispersion is supplied to the first housing tank 321 from each housing tank while changing the liquid supply rate, and 2) a method in which a housing tank containing a release agent particle dispersion and a housing tank containing a mixed dispersion in which second resin particles and release agent particles are dispersed are separately provided, and each dispersion is supplied to the first housing tank 321 from each housing tank while changing the liquid supply rate.

Thus, second aggregated particles are obtained in which the second resin particles and the release agent particles are aggregated on the surfaces of the first aggregated particles so as to adhere thereto.

Third Aggregated Particle Forming Step

Next, after obtaining a second aggregated particle dispersion in which the second aggregated particles are dispersed, the second aggregated particle dispersion is further mixed with a third resin particle dispersion in which third resin particles as a binder resin are dispersed.

The third resin particles may be the same type as or a different type from the first or second resin particles.

The third aggregated particles are aggregated on surfaces of the second aggregated particles in the dispersion in which the second aggregated particles and the third aggregated particles are dispersed. Specifically, for example, in the second aggregated particle forming step, when the second aggregated particles reach a target particle diameter, the third resin particle dispersion is added to the second aggregated particle dispersion, and this dispersion is heated at a temperature that is equal to or lower than the glass transition temperature of the third resin particles.

The proceeding of the aggregation is stopped by adjusting the pH of the dispersion to, for example, from about 6.5 to 8.5.

Coalescence Step

Next, a third aggregated particle dispersion in which the third aggregated particles are dispersed is heated at, for example, a temperature that is equal to or higher than the glass transition temperature of the first, second, and third resin particles (for example, a temperature that is higher than the glass transition temperature of the first, second, and third resin particles by from 10° C. to 30° C.) to coalesce the third aggregated particles and form toner particles.

Toner particles are obtained through the above steps.

Due to the above steps, the distribution characteristics of the eccentricity B of the release agent domain are within the above range in the obtained toner particles (toner).

Here, after the coalescence step ends, the toner particles formed in the solution are subjected to a washing step, a solid-liquid separation step, and a drying step, that are well known, and thus dry toner particles are obtained.

In the washing step, sufficient displacement washing with ion exchange water is preferably performed from the viewpoint of charging properties. In addition, the solid-liquid separation step is not particularly limited, but suction filtration, pressure filtration, or the like is preferably performed from the viewpoint of productivity. Furthermore, the method for the drying step is also not particularly limited, but freeze drying, flash jet drying, fluidized drying, vibration-type fluidized drying, or the like is preferably performed from the viewpoint of productivity.

Next, a case of preparing a toner having toner particles containing a urea-modified polyester resin will be described.

The toner particles containing the urea-modified polyester resin as a binder resin are preferably obtained by the following dissolution and suspension method. A method of obtaining toner particles containing an unmodified polyester resin and a urea-modified polyester resin as a binder resin will be shown. However, the toner particles may contain only the urea-modified polyester resin as a binder resin.

Oil Phase Liquid Preparation Step

An oil phase liquid in which toner particle materials including an unmodified polyester resin, a polyester prepolymer having an isocyanate group, an amine compound, a brilliant pigment, and a release agent are dissolved or dispersed in an organic solvent is prepared (oil phase liquid preparation step). This oil phase liquid preparation step is a step of obtaining a mixed liquid of toner materials by dissolving or dispersing toner particle materials in an organic solvent.

Examples of the method of preparing the oil phase liquid include 1) a preparation method including: collectively dissolving or dispersing toner materials in an organic solvent, 2) a preparation method including: kneading toner materials in advance; and dissolving or dispersing the kneaded material in an organic solvent, 3) a preparation method including: dissolving an unmodified polyester resin, a polyester prepolymer having an isocyanate group, and an amine compound in an organic solvent; and dispersing a brilliant pigment and a release agent in the organic solvent, 4) a preparation method including: dispersing a brilliant pigment and a release agent in an organic solvent; and dissolving an unmodified polyester resin, a polyester prepolymer having an isocyanate group, and an amine compound in the organic solvent, 5) a preparation method including: dissolving or dispersing toner particle materials (unmodified polyester resin, brilliant pigment, and release agent) other than a polyester prepolymer having an isocyanate group and an amine compound in an organic solvent; and dissolving the polyester prepolymer having an isocyanate group and the amine compound in the organic solvent, and 6) a preparation method including: dissolving or dispersing toner particle materials (unmodified polyester resin, brilliant pigment, and release agent) other than a polyester prepolymer having an isocyanate group or an amine compound in an organic solvent; and dissolving the polyester prepolymer having an isocyanate group or the amine compound in the organic solvent. The oil phase liquid preparation method is not limited thereto.

Examples of the organic solvent of the oil phase liquid include ester solvents such as methyl acetate and ethyl acetate; ketone solvents such as methyl ethyl ketone and methyl isopropyl ketone; aliphatic hydrocarbon solvents such as hexane and cyclohexane; and halogenated hydrocarbon solvents such as dichloromethane, chloroform, and trichloroethylene. These organic solvents dissolve the binder resin. The dissolution ratio thereof in water is preferably approximately from 0% by weight to 30% by weight, and the boiling point thereof is preferably 100° C. or lower. Among these organic solvents, ethyl acetate is preferable.

Suspension Preparation Step

Next, a suspension is prepared by dispersing the obtained oil phase liquid in an aqueous phase liquid (suspension preparation step).

The polyester prepolymer having an isocyanate group and the amine compound are reacted together with the preparation of the suspension. A urea-modified polyester resin is formed due to this reaction. This reaction is associated with at least one of a crosslinking reaction and an elongation reaction of molecular chains. The reaction between the polyester prepolymer having an isocyanate group and the amine compound a may be caused together with an organic solvent removal step to be described later.

Here, the reaction conditions are selected according to an isocyanate group structure of the polyester prepolymer and reactivity with the amine compound. For example, the reaction time is preferably from 10 minutes to 40 hours, and more preferably from 2 hours to 24 hours. The reaction temperature is preferably from 0° C. to 150° C., and more preferably from 40° C. to 98° C. For the preparation of the urea-modified polyester resin, a known catalyst (dibutyltin laurate, dioctyltin laurate, or the like) may be used if necessary. That is, a catalyst may be added to the oil phase liquid or the suspension.

As the aqueous phase liquid, an aqueous phase liquid in which a particle dispersant such as an organic particle dispersant or an inorganic particle dispersant is dispersed in an aqueous solvent is exemplified. As the aqueous phase liquid, an aqueous phase liquid in which a polymer dispersant is dissolved in an aqueous solvent with the dispersion of a particle dispersant in the aqueous solvent is also exemplified. A known additive such as a surfactant may be added to the aqueous phase liquid.

Examples of the aqueous solvent include water (e.g., generally, ion exchange water, distilled water, and pure water). The aqueous solvent may contain, in addition to water, an organic solvent such as alcohols (methanol, isopropyl alcohol, ethylene glycol, and the like), dimethylformamide, tetrahydrofuran, cellosolves (methyl cellosolve and the like), and lower ketones (acetone, methyl ethyl ketone, and the like).

Hydrophilic organic particle dispersants are exemplified as the organic particle dispersant. Examples of the organic particle dispersant include particles of alkyl poly(meth) acrylate resins (e.g., methyl polymethacrylate), polystyrene resins, and poly(styrene-acrylonitrile) resins. Examples of the organic particle dispersant also include particles of styrene acrylic resins.

Hydrophilic inorganic particle dispersants are exemplified as the inorganic particle dispersant. Specific examples of the inorganic particle dispersant include particles of silica, alumina, titania, calcium carbonate, magnesium carbonate, tricalcium phosphate, clay, diatomaceous earth, and bentonite, and particles of calcium carbonate are preferable. The inorganic particle dispersants may be used alone or in combination of two or more types thereof.

The particle dispersant may be subjected to a surface treatment with a polymer having a carboxyl group.

As the polymer having a carboxyl group, copolymers of an α,β-monoethylenic unsaturated carboxylic ester and at least one selected from salts (alkali metal salt, alkaline-earth metal salt, ammonium salt, amine salt, and the like) obtained by neutralizing an α,β-monoethylenic unsaturated carboxylic acid or a carboxyl group of an α,β-monoethylenic unsaturated carboxylic acid by alkali metal, alkaline-earth metal, ammonium, amine, and the like are exemplified. As the polymer having a carboxyl group, salts (alkali metal salt, alkaline-earth metal salt, ammonium salt, amine salt, and the like) obtained by neutralizing the carboxyl group of a copolymer of an α,β-monoethylenic unsaturated carboxylic acid and an α,β-monoethylenic unsaturated carboxylic ester by alkali metal, alkaline-earth metal, ammonium, amine, and the like are also exemplified. The polymers having a carboxyl group may be used alone or in combination of two or more types thereof.

Representative examples of the α,β-monoethylenic unsaturated carboxylic acid include α,β-unsaturated monocarboxylic acids (acrylic acid, methacrylic acid, crotonic acid, and the like) and α,β-unsaturated dicarboxylic acids (maleic acid, fumaric acid, itaconic acid, and the like). Representative examples of the α,β-monoethylenic unsaturated carboxylic acid ester include alkyl esters of (meth) acrylic acids, (meth)acrylates having an alkoxy group, (meth)acrylates having a cyclohexyl group, (meth)acrylates having a hydroxy group, and polyalkylene glycol mono (meth)acrylates.

Hydrophilic polymer dispersants are exemplified as the polymer dispersant. Specific examples of the polymer dispersant include polymer dispersants having a carboxyl group, but not having a lipophilic group (hydroxypropoxy group, methoxy group, and the like) (water-soluble cellulose ethers such as carboxymethyl cellulose and carboxyethyl cellulose).

Solvent Removal Step

Next, a toner particle dispersion is obtained by removing the organic solvent from the obtained suspension (solvent removal step). In this solvent removal step, the organic solvent contained in droplets of the aqueous phase liquid dispersed in the suspension is removed to form toner particles. The removal of the organic solvent from the suspension may be performed immediately after the suspension preparation step. The organic solvent may be removed after 1 minute or longer from the end of the suspension preparation step.

In the solvent removal step, the organic solvent may be removed from the suspension by cooling or heating the obtained suspension at a temperature of from 0° C. to 100° C.

Specific methods of removing the organic solvent are as follows.

(1) A method of forcibly updating a gas phase on the liquid surface of the suspension by blowing an air flow to the suspension. In this case, a gas may be blown into the suspension.

(2) A method of reducing the pressure. In this case, a gas phase on the liquid surface of the suspension may be forcibly updated by gas filling, or a gas may be blown into the suspension.

Toner particles are obtained through the above steps.

Here, after the solvent removal step ends, the toner particles formed in the toner particle dispersion are subjected to a washing step, a solid-liquid separation step, and a drying step, that are well known, and thus dry toner particles are obtained.

In the washing step, sufficient displacement washing with ion exchange water is preferably performed from the viewpoint of charging properties.

The solid-liquid separation step is not particularly limited, but suction filtration, pressure filtration, or the like is preferably performed from the viewpoint of productivity. Furthermore, the method for the drying step is also not particularly limited, but freeze drying, flash jet drying, fluidized drying, vibration-type fluidized drying, or the like are preferably performed from the viewpoint of productivity.

The toner according to this exemplary embodiment is prepared by, for example, adding an external additive to dry toner particles that have been obtained, and mixing them.

The method of mixing the toner particles with the external additive is not particularly limited as long as the toner of this exemplary embodiment is obtained.

However, for example, when toner particles are mixed with an external additive containing fatty acid metal salt particles and abrasive particles at once, the abrasive particles have a high specific gravity, and thus the adhesion between the fatty acid metal salt particles and the toner particles may be too strong due to the abrasive particles.

Therefore, for example, the toner particles are preferably mixed with the external additive containing fatty acid metal salt particles and abrasive particles through a method exemplified in the following description. When the toner particles are mixed with the external additive containing fatty acid metal salt particles and abrasive particles through this method, a toner satisfying the above-described ratio of the isolation amount of the abrasive particles to the isolation amount of the fatty acid metal salt particles is easily obtained.

Specifically, first, a mixture is obtained by mixing toner particles, fatty acid metal salt particles, and other additives using a mixer (e.g., V-blender, HENSCHEL mixer, or LÖEDIGE mixer). This mixture is sieved by a wind classifier (e.g., HI-BOLTER), and then the mixture after sieving is collected by a collector (e.g., CYCLONE). When the mixture after sieving is collected by the collector, abrasive particles are added to obtain a toner having toner particles and an external additive containing fatty acid metal salt particles and abrasive particles.

Examples of the method of adjusting a ratio of an isolation amount of the abrasive particles to an isolation amount of the fatty acid metal salt particles include a method of changing a time period from the addition of the abrasive particles to the collector to the initiation of a stop operation of the collector.

Electrostatic Charge Image Developer

An electrostatic charge image developer according to this exemplary embodiment contains at least the toner according to this exemplary embodiment.

The electrostatic charge image developer according to this exemplary embodiment may be a single-component developer including only the toner according to this exemplary embodiment, or may be a two-component developer obtained by mixing the toner with a carrier.

The carrier is not particularly limited, and known carriers are exemplified. Examples of the carrier include coated carriers in which surfaces of cores composed of magnetic particles are coated with a coating resin; magnetic particle dispersion-type carriers in which magnetic particles are dispersed and blended in a matrix resin; and resin impregnation-type carriers in which magnetic particles are impregnated with a resin.

The magnetic particle dispersion-type carriers and the resin impregnation-type carriers may be carriers in which constituent particles of the carrier are cores and coated with a coating resin.

Examples of the magnetic particles include magnetic metals such as iron, nickel, and cobalt, and magnetic oxides such as ferrite and magnetite.

Examples of the coating resin and the matrix resin include polyethylene, polypropylene, polystyrene, polyvinyl acetate, polyvinyl alcohol, polyvinyl butyral, polyvinyl chloride, polyvinyl ether, polyvinyl ketone, a vinyl chloride-vinyl acetate copolymer, a styrene-acrylic acid copolymer, a straight silicone resin including an organosiloxane bond or a modified product thereof, a fluororesin, polyester, polycarbonate, a phenol resin, and an epoxy resin.

The coating resin and the matrix resin may contain other additives such as conductive particles.

Examples of the conductive particles include particles of a metal such as gold, silver, or copper, carbon black, titanium oxide, zinc oxide, tin oxide, barium oxide, aluminum borate, or potassium titanate.

Here, in order to coat the surface of a core with the coating resin, a coating method using a coating layer forming solution in which a coating resin, and if necessary, various additives are dissolved in an appropriate solvent may be used. The solvent is not particularly limited, and may be selected in consideration of the coating resin to be used, coating suitability, and the like.

Specific examples of the resin coating method include a dipping method of dipping cores in a coating layer forming solution, a spraying method of spraying a coating layer forming solution to surfaces of cores, a fluid bed method of spraying a coating layer forming solution in a state in which cores are allowed to float by flowing air, and a kneader-coater method in which cores of a carrier and a coating layer forming solution are mixed with each other in a kneader-coater and the solvent is removed.

The mixing ratio (weight ratio) between the toner and the carrier in the two-component developer is preferably from 1:100 to 30:100 (toner:carrier), and more preferably from 3:100 to 20:100.

Image Forming Apparatus and Image Forming Method

An image forming apparatus and an image forming method according to this exemplary embodiment will be described.

The image forming apparatus according to this exemplary embodiment is provided with an image holding member, a charging unit which charges a surface of the image holding member, an electrostatic charge image forming unit which forms an electrostatic charge image on the charged surface of the image holding member, a developing unit which contains an electrostatic charge image developer and develops the electrostatic charge image formed on the surface of the image holding member with the electrostatic charge image developer to form a toner image, a transfer unit which transfers the toner image formed on the surface of the image holding member onto a surface of a recording medium, a cleaning unit having a cleaning blade which cleans the surface of the image holding member, and a fixing unit which fixes the toner image transferred onto the surface of the recording medium. As the electrostatic charge image developer, the electrostatic charge image developer according to this exemplary embodiment is applied.

In the image forming apparatus according to this exemplary embodiment, an image forming method (image forming method according to this exemplary embodiment) including the steps of: charging a surface of an image holding member; forming an electrostatic charge image on the charged surface of the image holding member; developing the electrostatic charge image formed on the surface of the image holding member with the electrostatic charge image developer according to this exemplary embodiment to form a toner image; transferring the toner image formed on the surface of the image holding member onto a surface of a recording medium; cleaning the surface of the image holding member by a cleaning blade; and fixing the toner image transferred onto the surface of the recording medium is performed.

As the image forming apparatus according to this exemplary embodiment, a known image forming apparatus is applied, such as a direct transfer-type apparatus which directly transfers a toner image formed on a surface of an image holding member onto a recording medium; an intermediate transfer-type apparatus which primarily transfers a toner image formed on a surface of an image holding member onto a surface of an intermediate transfer member, and secondarily transfers the toner image transferred onto the surface of the intermediate transfer member onto a surface of a recording medium; or an apparatus which is provided with an erasing unit which irradiates, after transfer of a toner image, a surface of an image holding member with erase light before charging for erasing.

In the case of an intermediate transfer-type apparatus, a transfer unit is configured to have, for example, an intermediate transfer member having a surface onto which a toner image is to be transferred, a primary transfer unit which primarily transfers a toner image formed on a surface of an image holding member onto the surface of the intermediate transfer member, and a secondary transfer unit which secondarily transfers the toner image transferred onto the surface of the intermediate transfer member onto a surface of a recording medium.

In the image forming apparatus according to this exemplary embodiment, for example, a part including the developing unit may have a cartridge structure (process cartridge) which is detachable from the image forming apparatus. As the process cartridge, for example, a process cartridge provided with a developing unit containing the electrostatic charge image developer according to this exemplary embodiment is preferably used.

Hereinafter, an example of the image forming apparatus according to this exemplary embodiment will be shown. However, the image forming apparatus is not limited thereto. Major parts shown in the drawing will be described, but descriptions of other parts will be omitted.

FIG. 1 is a configuration diagram of an image forming apparatus according to this exemplary embodiment.

The image forming apparatus illustrated in FIG. 1 is provided with first to fourth electrophotographic image forming units 10Y, 10M, 10C, and 10K (image forming units) which output yellow (Y), magenta (M), cyan (C), and black (K) images based on color-separated image data, respectively. These image forming units (hereinafter, may be simply referred to as "units") 10Y, 10M, 10C, and 10K are arranged side by side at predetermined intervals in a horizontal direction. These units 10Y, 10M, 10C, and 10K may be process cartridges which are detachable from the image forming apparatus.

An intermediate transfer belt 20 as an intermediate transfer member is installed above the units 10Y, 10M, 10C, and 10K in the drawing to extend through the units. The intermediate transfer belt 20 is wound on a driving roll 22 and a support roll 24 contacting the inner surface of the intermediate transfer belt 20, which are separated from each other on the left and right sides in the drawing, and travels in a direction toward the fourth unit 10K from the first unit 10Y. The support roll 24 is pressed in a direction in which it departs from the driving roll 22 by a spring or the like (not shown), and a tension is given to the intermediate transfer belt 20 wound on both of the rolls. In addition, an intermediate transfer member cleaning device 30 opposed to the driving roll 22 is provided on a surface of the intermediate transfer belt 20 on the image holding member side.

Developing devices (developing units) 4Y, 4M, 4C, and 4K of the units 10Y, 10M, 10C, and 10K are supplied with toners including four color toners, that is, a yellow toner, a magenta toner, a cyan toner, and a black toner contained in toner cartridges 8Y, 8M, 8C, and 8K, respectively.

The first to fourth units 10Y, 10M, 10C, and 10K have the same configuration. Here, the first unit 10Y which is disposed on the upstream side in a traveling direction of the intermediate transfer belt to form a yellow image will be representatively described. The same parts as in the first unit 10Y will be denoted by the reference numerals with magenta (M), cyan (C), and black (K) added instead of yellow (Y), and descriptions of the second to fourth units 10M, 10C, and 10K will be omitted.

The first unit 10Y has a photoreceptor 1Y acting as an image holding member. Around the photoreceptor 1Y, a charging roll (an example of the charging unit) 2Y which charges a surface of the photoreceptor 1Y to a predetermined potential, an exposure device (an example of the electrostatic charge image forming unit) 3 which exposes the charged surface with laser beams 3Y based on a color-separated image signal to form an electrostatic charge image, a developing device (an example of the developing unit) 4Y which supplies a charged toner to the electrostatic charge image to develop the electrostatic charge image, a primary transfer roll (an example of the primary transfer unit) 5Y which transfers the developed toner image onto the intermediate transfer belt 20, and a photoreceptor cleaning device (an example of the cleaning unit) 6Y having a cleaning blade 6Y-1 which removes the toner remaining on the surface of the photoreceptor 1Y after primary transfer, are arranged in sequence.

The primary transfer roll 5Y is disposed inside the intermediate transfer belt 20 so as to be provided at a position opposed to the photoreceptor 1Y. Furthermore, bias supplies (not shown) which apply a primary transfer bias are connected to the primary transfer rolls 5Y, 5M, 5C, and 5K, respectively. Each bias supply changes a transfer bias that is applied to each primary transfer roll under the control of a controller (not shown).

Hereinafter, an operation of forming a yellow image in the first unit 10Y will be described.

First, before the operation, the surface of the photoreceptor 1Y is charged to a potential of from −600 V to −800 V by the charging roll 2Y.

The photoreceptor 1Y is formed by laminating a photosensitive layer on a conductive substrate (for example, volume resistivity at 20° C.: $1\times10^{-6}$ Ωcm or less). The photosensitive layer typically has high resistance (that is about the same as the resistance of a general resin), but has properties in which when laser beams 3Y are applied, the specific resistance of a part irradiated with the laser beams changes. Accordingly, the laser beams 3Y are output to the charged surface of the photoreceptor 1Y via the exposure device 3 in accordance with image data for yellow sent from the controller (not shown). The laser beams 3Y are applied to the photosensitive layer on the surface of the photoreceptor 1Y, whereby an electrostatic charge image of a yellow image pattern is formed on the surface of the photoreceptor 1Y.

The electrostatic charge image is an image formed on the surface of the photoreceptor 1Y by charging, and is a so-called negative latent image, that is formed by applying the laser beams 3Y to the photosensitive layer such that the specific resistance of the irradiated part is lowered to cause charges to flow on the surface of the photoreceptor 1Y, while charges stay on a part to which the laser beams 3Y are not applied.

The electrostatic charge image formed on the photoreceptor 1Y is rotated up to a predetermined developing position with the travelling of the photoreceptor 1Y. The electrostatic charge image on the photoreceptor 1Y is visualized (developed) as a toner image at the developing position by the developing device 4Y.

The developing device 4Y contains, for example, an electrostatic charge image developer containing at least a yellow toner and a carrier. The yellow toner is frictionally charged by being stirred in the developing device 4Y to have a charge with the same polarity (negative polarity) as the charge that is on the photoreceptor 1Y, and is thus held on the developer roll (an example of the developer holding member). By allowing the surface of the photoreceptor 1Y to pass through the developing device 4Y, the yellow toner is electrostatically adhered to an erased latent image part on the surface of the photoreceptor 1Y, whereby the latent image is developed with the yellow toner. Next, the photoreceptor 1Y having the yellow toner image formed thereon travels at a predetermined rate and the toner image developed on the photoreceptor 1Y is transported to a predetermined primary transfer position.

When the yellow toner image on the photoreceptor 1Y is transported to the primary transfer position, a primary transfer bias is applied to the primary transfer roll 5Y, an electrostatic force toward the primary transfer roll 5Y from the photoreceptor 1Y acts on the toner image, and the toner image on the photoreceptor 1Y is transferred onto the intermediate transfer belt 20. The transfer bias applied at this time has the opposite polarity (+) of the toner polarity (−), and is controlled to +10 μA by the controller (not shown) in the first unit 10Y.

On the other hand, the toner remaining on the photoreceptor 1Y is removed and collected by the cleaning blade 6Y-1 of the photoreceptor cleaning device 6Y.

The primary transfer biases that are applied to the primary transfer rolls 5M, 5C, and 5K of the second unit 10M and the subsequent units are also controlled in the same manner as in the case of the first unit.

In this manner, the intermediate transfer belt 20 onto which the yellow toner image has been transferred in the first unit 10Y is sequentially transported through the second to fourth units 10M, 10C, and 10K, and the toner images of respective colors are multiply-transferred in a superimposed manner.

The intermediate transfer belt 20 onto which the four color toner images have been multiply-transferred through the first to fourth units reaches a secondary transfer part that is composed of the intermediate transfer belt 20, the support roll 24 contacting the inner surface of the intermediate transfer belt, and a secondary transfer roll (an example of the secondary transfer unit) 26 disposed on the image holding surface side of the intermediate transfer belt 20. Meanwhile, a recording sheet (an example of the recording medium) P is supplied to a gap between the secondary transfer roll 26 and the intermediate transfer belt 20, that are brought into contact with each other, via a supply mechanism at a predetermined timing, and a secondary transfer bias is applied to the support roll 24. The transfer bias applied at this time has the same polarity (−) as the toner polarity (−), and an electrostatic force toward the recording sheet P from the intermediate transfer belt 20 acts on the toner image, whereby the toner image on the intermediate transfer belt 20 is transferred onto the recording sheet P. In this case, the secondary transfer bias is determined depending on the resistance detected by a resistance detector (not shown) that detects the resistance of the secondary transfer part, and is voltage-controlled.

Thereafter, the recording sheet P is transported to a pressure-contacting part (nip part) between a pair of fixing rolls in a fixing device (an example of the fixing unit) 28 such that the toner image is fixed to the recording sheet P, whereby a fixed image is formed.

Examples of the recording sheet P onto which a toner image is to be transferred include plain paper that is used in electrophotographic copying machines, printers, and the like. As a recording medium, an OHP sheet and the like are also exemplified other than the recording sheet P.

The surface of the recording sheet P is preferably smooth in order to further improve smoothness of the image surface after fixing. For example, coating paper obtained by coating a surface of plain paper with a resin or the like, art paper for printing, and the like are preferably used.

The recording sheet P on which the fixing of the color image is completed is discharged toward a discharge part, and a series of the color image forming operations ends.

Process Cartridge and Toner Cartridge

A process cartridge according to this exemplary embodiment will be described.

The process cartridge according to this exemplary embodiment is provided with a developing unit which contains the electrostatic charge image developer according to this exemplary embodiment and develops an electrostatic charge image formed on a surface of an image holding member with the electrostatic charge image developer to form a toner image, and is detachable from an image forming apparatus.

The process cartridge according to this exemplary embodiment is not limited to the above-described configuration, and may be configured to include a developing device, and if necessary, at least one selected from other units such as an image holding member, a charging unit, an electrostatic charge image forming unit, and a transfer unit.

Hereinafter, an example of the process cartridge according to this exemplary embodiment will be shown. However, the process cartridge is not limited thereto. Major parts shown in the drawing will be described, but descriptions of other parts will be omitted.

Figure 2:
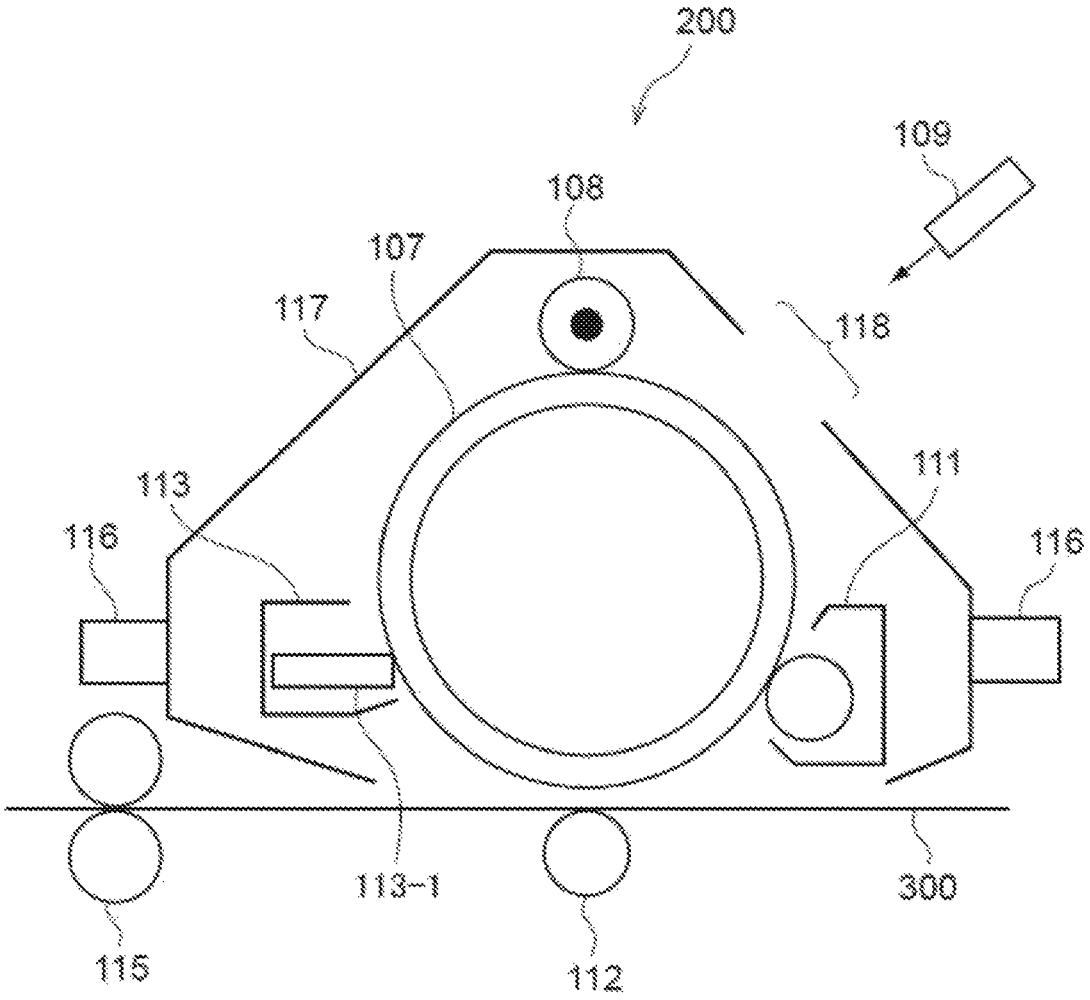
FIG. 2 is a configuration diagram of an example of a process cartridge according to an exemplary embodiment.

FIG. 2 is a configuration diagram of the process cartridge according to this exemplary embodiment.

A process cartridge 200 shown in FIG. 2 is formed as a cartridge having a configuration in which a photoreceptor 107 (an example of the image holding member), and a charging roll 108 (an example of the charging unit), a developing device 111 (an example of the developing unit), and a photoreceptor cleaning device 113 (an example of the cleaning unit) having a cleaning blade 113-1, which are provided around the photoreceptor 107, are integrally combined and held by, for example, a housing 117 provided with a mounting rail 116 and an opening 118 for exposure.

In FIG. 2, the reference numeral 109 represents an exposure device (an example of the electrostatic charge image forming unit), the reference numeral 112 represents a transfer device (an example of the transfer unit), the reference numeral 115 represents a fixing device (an example of the fixing unit), and the reference numeral 300 represents a recording sheet (an example of the recording medium).

Next, a toner cartridge according to this exemplary embodiment will be described.

The toner cartridge according to this exemplary embodiment is a toner cartridge which contains the toner according to this exemplary embodiment and is detachable from an image forming apparatus. The toner cartridge may include a container that contains the toner. The toner cartridge contains a toner for replenishment for being supplied to the developing unit provided in the image forming apparatus.

The image forming apparatus shown in FIG. 1 has a configuration in which the toner cartridges 8Y, 8M, 8C, and 8K are detachable therefrom, and the developing devices 4Y, 4M, 4C, and 4K are connected to the toner cartridges corresponding to the respective developing devices (colors) with toner supply tubes (not shown), respectively. In addition, in a case in which the toner contained in the toner cartridge runs low, the toner cartridge is replaced.

EXAMPLES

Hereinafter, this exemplary embodiment will be described in more detail using examples and comparative examples, but is not limited to the following examples. Unless specifically noted, "parts" and "%" are "parts by weight" and "% by weight", respectively.

Preparation of Fatty Acid Metal Salt Particles

Preparation of Zinc Stearate Particles (ZnSt1)

1,422 parts of a stearic acid is added to and mixed with 10,000 parts of ethanol at a liquid temperature of 75° C. Then, 507 parts of zinc hydroxide is added thereto little by little, and stirred and mixed for 1 hour after the end of the addition. Thereafter, the mixture is cooled to a liquid temperature of 20° C. The product is separated by filtering to remove the ethanol and the reaction residues, and thus a solid material is obtained. Using a heating-type vacuum dryer, the obtained solid material is dried for 3 hours at 150° C. The solid material is taken out of the dryer and cooled, and thus, a solid material of zinc stearate is obtained.

The obtained solid material is pulverized, and then classified by an ELBOW-JET CLASSIFIER (manufactured by Matsubo Corporation), and thus, zinc stearate particles (ZnSt1) are obtained.

The number average particle diameter of the obtained zinc stearate (ZnSt1) measured through the above-described method is as follows.

Zinc Stearate Particles (ZnSt1): 1.2

Preparation of Zinc Laurate Particles (Znla1)

1,001 parts of a lauric acid is added to and mixed with 10,000 parts of ethanol at a liquid temperature of 75° C. Then, 507 parts of zinc hydroxide is added little by little, and stirred and mixed for 1 hour after the end of the addition. Thereafter, the mixture is cooled to a liquid temperature of 20° C. The product is separated by filtering to remove the ethanol and the reaction residues, and the obtained solid material is dried for 3 hours at 150° C. using a heating-type vacuum dryer. The solid material is taken out of the dryer and cooled, and then a solid material of zinc laurate is obtained. The obtained solid material is pulverized and classified in the same manner as in the case of the zinc stearate particles (Znst1) to thereby obtain zinc laurate particles.

The number average particle diameter of the obtained zinc laurate measured by the above-described method is as follows.

Zinc Laurate Particles (Znla1): 1.5 μm.

Preparation of Abrasive Particles

An equimolar amount of strontium chloride relative to a titanium oxide is added to a metatitanic acid slurry. Then, carbon dioxide is allowed to flow at a flow rate of 1 L/min as much as 2 times moles in relation to the moles of the titanium oxide, and at the same time, ammonia water is added. At this time, the pH value is 8. Precipitates are water-washed, and then dried for 24 hours at 110° C. The obtained material is sintered at 800° C., mechanically pulverized, and classified, and thus, abrasive particles (a) of strontium titanate are prepared. In addition, by adjusting the pulverization conditions and the classification conditions, abrasive particles (b) and (C) of strontium titanate are prepared. The number average particle diameters of the obtained abrasive particles (a) to (c) are as follows.

Abrasive Particles (a): Strontium Titanate Particles (number average particle diameter: 5.0 μm)

Abrasive Particles (b): Strontium Titanate Particles (number average particle diameter: 3.2 μm)

Abrasive Particles (c): Strontium Titanate Particles (number average particle diameter: 6.9 μm)

Other than the above-described abrasive particles (a) to (c), the following abrasive particles are prepared as the abrasive particles.

Abrasive Particles (d): Calcium Titanate Particles (number average particle diameter: 4.3 μm)

Abrasive Particles (e): Cerium Oxide Particles (number average particle diameter: 5.0 μm)

Preparation of Toner Particles A

Preparation of Polyester Resin Dispersion (1)

1,9-Nonanediol: 45 parts by mole

Dodecanedicarboxylic Acid: 55 parts by mole

The above components are put into a three-necked flask dried by heating. 0.05 parts by mole of dibutyltin oxide is put thereinto as a catalyst. Then, nitrogen gas is supplied by a pressure reducing operation such that the air in the container is under an inert atmosphere, and mechanical stirring and recirculation are performed for 2 hours at 180° C. Then, the temperature is slowly increased to 230° C. under reduced pressure and stirring is performed for 5 hours.

At the time when the obtained material becomes viscous, air-cooling is performed to stop the reaction, whereby a polyester resin is synthesized. A weight average molecular weight (Mw) of the obtained polyester resin is 25,000 as a result of measurement by gel permeation chromatography (in terms of polystyrene).

Next, 3,000 parts of the obtained polyester resin, 10,000 parts of ion exchange water, and 90 parts of a surfactant sodium dodecylbenzenesulfonate are put into an emulsifying tank of a high-temperature/high-pressure emulsifying device (CAVITRON CD1010, slit: 0.4 mm), and then melted by heating at 130° C. Then, the obtained material is subjected to dispersion through 10,000 rpm for 30 minutes at 110° C. and a flow rate of 3 L/m, and is allowed to pass through a cooling tank to collect a crystalline polyester resin dispersion (high-temperature/high-pressure emulsifying device (CAVITRON CD1010, slit: 0.4 mm, manufactured by Eurotec, Ltd.), thereby obtaining a polyester resin dispersion (1) having a solid content of 20%.

Preparation of Polyester Resin Dispersion (2)

Ethylene Oxide Adduct of Bisphenol A: 15 parts by mole

Propylene Oxide Adduct of Bisphenol A: 85 parts by mole

Terephthalic Acid: 10 parts by mole

Fumaric Acid: 67 parts by mole n-Dodecenyl Succinic Acid: 3 parts by mole

Trimellitic Acid: 20 parts by mole

The above components are put into a three-necked flask dried by heating. 0.05 parts by mole of dibutyltin oxide is put thereinto with respect to the acid components (total number of moles of the terephthalic acid, the n-dodecenyl succinic acid, the trimellitic acid, and the fumaric acid). Then, nitrogen gas is charged into the container such that the air in the container is kept in an inert atmosphere, and the temperature is increased. Then, a co-condensation polymerization reaction is caused from 12 hours to 20 hours at from 150° C. to 230° C. Thereafter, the pressure is slowly reduced at from 210° C. to 250° C. to synthesize a polyester resin. A weight average molecular weight (Mw) of the resin is 65,000.

Next, 3,000 parts of the obtained polyester resin, 10,000 parts of ion exchange water, and 90 parts of a surfactant sodium dodecylbenzenesulfonate are put into an emulsifying tank of a high-temperature/high-pressure emulsifying device (CAVITRON CD1010, slit: 0.4 mm), and then melted by heating at 130° C. Then, the obtained material is subjected to dispersion through 10,000 rpm for 30 minutes at 110° C. and a flow rate of 3 L/m, and is allowed to pass through a cooling tank to collect a polyester resin dispersion (high-temperature/high-pressure emulsifying device (CAVITRON CD1010, slit: 0.4 mm, manufactured by Eurotec, Ltd.), thereby obtaining a polyester resin dispersion (2) having a solid content of 20%.

Preparation of Colorant Particle Dispersion (1)

Cyan Pigment (copper phthalocyanine, C.I. Pigment Blue 15:3: manufactured by Dainichiseika Color & Chemicals Mfg. Co., Ltd.): 100 parts Anionic Surfactant NEOGEN RK (manufactured by DKS Co. Ltd.): 10 parts Ion Exchange Water: 400 parts The above materials are mixed and dispersed for 10 minutes using a homogenizer (ULTRA TURRAX T50, manufactured by IKA), and then ion exchange water is added to obtain a colorant particle dispersion (1) having a volume average particle diameter of 190 nm and a solid content of 20% by weight.

Preparation of Release Agent Particle Dispersion (1)

Paraffin Wax (HNP9, manufactured by Nippon Seiro Co., Ltd.: melting temperature 75° C.): 46 parts Anionic Surfactant NEOGEN RK (manufactured by DKS Co. Ltd.): 5 parts Ion Exchange Water: 200 parts The above components are mixed, heated at 100° C., and sufficiently dispersed by a homogenizer (ULTRA TURRAX T50, manufactured by IKA). Thereafter, a dispersion treatment is performed by a pressure discharge-type GORLIN HOMOGENIZER (manufactured by Gorlin Co., Ltd.) to obtain a release agent particle dispersion (1) having a volume average particle diameter of 200 nm and a solid content of 20%.

Preparation of Toner Particles (A-1)

Polyester Resin Dispersion (1): 33 parts

Polyester Resin Dispersion (2): 257 parts

Colorant Particle Dispersion (1): 27 parts

Release Agent Particle Dispersion (1): 35 parts

The above components are put into a stainless-steel flask, and mixed and dispersed by a homogenizer (ULTRA TURRAX T50, manufactured by IKA). 0.20 parts of polyaluminum chloride is added thereto, and the dispersion operation is continued by the homogenizer. The dispersion in the flask is heated to 48° C. in a heating oil bath under stirring. After holding for 60 minutes at 48° C., 70 parts of the polyester resin dispersion (2) is additionally added. Thereafter, the pH in the system is adjusted to 8.0 with a 0.5 N sodium hydroxide aqueous solution, and then the stainless-steel flask is sealed. Using a magnetic seal, the dispersion is heated to 96° C. while being continuously stirred, and is held for 3 hours. After the end of the reaction, cooling, filtering, and washing using ion exchange water are performed, and then solid-liquid separation is performed by Nutsche-type suction filtering. The obtained material is redispersed in 1,000 parts of ion exchange water at 30° C., stirred for 15 minutes at 300 rpm, and washed. This operation is repeated five times, and when the pH of the filtrate is 7.5 and the electric conductivity is 7.0 μS/cm, solid-liquid separation is performed using filter paper No. 5A by Nutsche-type suction filtering. Next, vacuum drying is continued for 12 hours, and thus toner particles (A-1) are obtained.

The volume average particle diameter of the obtained toner particles (A-1) is 5.8 μm as a result of measurement by the above-described method.

The maximum frequent value and the skewness of the distribution of an eccentricity B of the release agent domain are 0.65 and −0.50, respectively, as a result of measurement by the above-described method.

Preparation of Toner Particles B

Preparation of Polyester Resin Dispersion (3)

Ethylene Oxide Adduct of Bisphenol A: 5 parts by mole

Propylene Oxide Adduct of Bisphenol A: 95 parts by mole

Terephthalic Acid: 30 parts by mole

Fumaric Acid: 70 parts by mole

The above components are put into a flask having an internal capacity of 5 L and provided with a stirrer, a nitrogen introduction tube, a temperature sensor, and a rectifying column. Then, the temperature is increased to 210° C. over 1 hour, and 1 part of titanium tetraethoxide is put with respect to 100 parts of the materials. The temperature is increased to 230° C. over 0.5 hour while the generated water is distilled off, and a dehydrative condensation reaction is continued for 1 hour at 230° C. Then, the reactant is cooled, and thus a polyester resin is obtained. A weight average molecular weight (Mw) of the obtained polyester resin is 18,500 as a result of measurement by gel permeation chromatography (in terms of polystyrene).

Next, 40 parts of ethyl acetate and 25 parts of 2-butanol are put to obtain a mixed solvent. Then, 100 parts of a polyester resin is slowly put and dissolved, and an aqueous solution of 10 wt % ammonia (corresponding to 3 times the acid value of the resin in terms of molar ratio) is added thereto and stirred for 30 minutes.

Next, the atmosphere in the container is substituted with dry nitrogen, and the temperature is maintained at 40° C. While the mixed liquid is stirred, 400 parts of ion exchange water is dripped at a rate of 2 parts/min to perform emulsification. After the end of dripping, the emulsion is returned to a room temperature (from 20° C. to 25° C.), and bubbling is performed by dry nitrogen for 48 hours during stirring to reduce the content of the ethyl acetate and 2-butanol to 1,000 ppm or less, thereby obtaining a resin particle dispersion in which resin particles having a volume average particle diameter of 200 nm are dispersed. Ion exchange water is added to the resin particle dispersion, and thus a polyester resin dispersion (3) having a solid content of 20% by weight is obtained.

Preparation of Toner Particles (B-1)

An apparatus (see FIG. 3) in which a round stainless-steel flask and a container A are connected to each other by a tube pump A to supply a liquid contained in the container A to the flask by drive of the tube pump, and the container A and a container B are connected to each other by a tube pump B to supply a liquid contained in the container B to the container A by drive of the tube pump B is prepared. Using this apparatus, the following operation is performed.

Polyester Resin Dispersion (3): 500 parts

Colorant Particle Dispersion (1): 40 parts

Anionic Surfactant (TaycaPower): 2 parts

The above materials are put into a round stainless-steel flask, and a 0.1 N nitric acid is added thereto to adjust the pH to 3.5. Then, 30 parts of a nitric acid aqueous solution having a polyaluminum chloride concentration of 10% by weight is added. Next, the mixture is subjected to dispersion at 30° C. using a homogenizer (ULTRA TURRAX T50, manufactured by IKA), and then the particle diameter of aggregated particles is increased while the temperature is increased at a rate of 1° C./30 minutes in a heating oil bath.

150 parts of the polyester resin dispersion (3) is put into the container A which is a polyester bottle, and likewise, 25 parts of the release agent particle dispersion (1) is put into the container B. Next, the liquid supply rate of the tube pump A is set to 0.70 parts/min and the liquid supply rate of the tube pump B is set to 0.14 parts/min. From the time when the temperature in the round stainless-steel flask during the formation of aggregated particles reaches 37° C., the tube pumps A and B are driven to start the supply of the dispersions. Accordingly, while slowly increasing the concentration of the release agent particles, the mixed dispersion in which the resin particles and the release agent particles are dispersed is supplied from the container A to the round stainless-steel flask during the formation of aggregated particles.

From when the supply of the dispersions to the flask is completed and the temperature in the flask reaches 48° C., the dispersions are held for 30 minutes, and second aggregated particles are formed.

Thereafter, 50 parts of the polyester resin dispersion (3) is slowly added and held for 1 hour, and a 0.1 N sodium hydroxide aqueous solution is added to adjust the pH to 8.5. Then, the obtained material is heated to 85° C. while being continuously stirred, and is held for 5 hours. Thereafter, it is cooled to 20° C. at a rate of 20° C./min, filtered, sufficiently washed with ion exchange water, and dried, and thus, toner particles (B-1) are obtained.

The volume average particle diameter of the obtained toner particles (B-1) is 6.0 μm as a result of measurement by the above-described method.

The maximum frequent value and the skewness of the distribution of an eccentricity B of the release agent domain are 0.88 and −0.80, respectively, as a result of measurement by the above-described method.

Preparation of Toner Particles (B-2)

Toner particles (B-2) are obtained in the same manner as in the case of the toner particles (B-1), except that in the preparation of the toner particles (B-1), the liquid supply rate of the tube pump A is set to 0.70 parts/min, the liquid supply rate of the tube pump B is set to 0.14 parts/min, and the tube pumps A and B are driven from the time when the temperature in the flask reaches 40.0° C.

The volume average particle diameter of the obtained toner particles (B-2) is 6.0 μm as a result of measurement by the above-described method.

The maximum frequent value and the skewness of the distribution of an eccentricity B of the release agent domain are 0.97 and −0.79, respectively, as a result of measurement by the above-described method.

Preparation of Toner Particles (B-3)

Toner particles (B-3) are obtained in the same manner as in the case of the toner particles (B-1), except that in the preparation of the toner particles (B-1), the liquid supply rate of the tube pump A is set to 0.85 parts/min, the liquid supply rate of the tube pump B is set to 0.14 parts/min, and the tube pumps A and B are driven from the time when the temperature in the flask reaches 37.0° C.

The volume average particle diameter of the obtained toner particles (B-3) is 6.0 μm as a result of measurement by the above-described method.

The maximum frequent value and the skewness of the distribution of an eccentricity B of the release agent domain are 0.85 and −0.52, respectively, as a result of measurement by the above-described method.

Preparation of Toner Particles C

Preparation of Unmodified Polyester Resin (1)

Terephthalic Acid: 1,243 parts

Ethylene Oxide Adduct of Bisphenol A: 1,830 parts

Propylene Oxide Adduct of Bisphenol A: 840 parts

The above components are heated and mixed at 180° C., and then 3 parts of dibutyltin oxide is added thereto. While the mixture is heated at 220° C., water is distilled off, and a polyester resin is obtained. 1,500 parts of cyclohexanone is added to the obtained polyester to dissolve the polyester resin, and 250 parts of acetic anhydride is added to this cyclohexanone solution and heated at 130° C. Furthermore, this solution is heated under reduced pressure to remove the solvent and the unreacted acid, and an unmodified polyester resin (1) is obtained. The glass transition temperature of the obtained unmodified polyester resin (1) is 60° C.

Preparation of Polyester Prepolymer (1)

Terephthalic Acid: 1243 parts

Ethylene Oxide Adduct of Bisphenol A: 1830 parts

Propylene Oxide Adduct of Bisphenol A: 840 parts

The above components are heated and mixed at 180° C., and then 3 parts of dibutyltin oxide is added thereto. While the mixture is heated at 220° C., water is distilled off, and a polyester prepolymer is obtained. 350 parts of the obtained polyester prepolymer, 50 parts of tolylene diisocyanate, and 450 parts of ethyl acetate are put into the container. By heating this mixture for 3 hours at 130° C., a polyester prepolymer (1) (hereinafter, "isocyanate-modified polyester prepolymer (1)") having an isocyanate group is obtained.

Preparation of Ketimine Compound (1)

50 parts of methyl ethyl ketone and 150 parts of hexamethylene diamine are put into a container and stirred at 60° C., and thus a ketimine compound (1) is obtained.

Preparation of Release Agent Particle Dispersion (2)

Paraffin Wax (melting temperature: 89° C.): 30 parts

Ethyl Acetate: 270 parts

In a state in which the above components are cooled at 10° C., the components are wet-pulverized by micro bead-type disperser (DCP mill), and a release agent particle dispersion (2) is obtained.

Preparation of Oil Phase Liquid (1)

Unmodified Polyester Resin (1): 136 parts

Ethyl Acetate: 56 parts

The above components are stirred and mixed, and then 75 parts of the release agent particle dispersion (2) is added to the obtained mixture and stirred. Thus, an oil phase liquid (1) is obtained.

Preparation of Styrene-Acrylic Resin Particle Dispersion (1)

Styrene: 370 parts n-Butyl Acrylate: 30 parts

Acrylic Acid: 4 parts

Dodecanethiol: 24 parts

Carbon Tetrabromide: 4 parts

A mixture obtained by mixing and dissolving the above components is dispersed and emulsified in an aqueous solution obtained by dissolving 6 parts of a nonionic surfactant (manufactured by Sanyo Chemical Industries, Ltd.: NONIPOL 400) and 10 parts of an anionic surfactant (manufactured by DKS Co., Ltd.: NEOGEN SC) in 560 parts of ion exchange water in a flask. Then, while the components are mixed for 10 minutes, an aqueous solution obtained by dissolving 4 parts of ammonium persulfate in 50 parts of ion exchange water is added thereto and nitrogen substitution is performed. Then, while being stirred, the content in the flask is heated in an oil bath until its temperature is increased to 70° C., and emulsion polymerization is continued for 5 hours. In this manner, a styrene-acrylic resin particle dispersion (1) (resin particle concentration: 40% by weight) in which resin particles having an average particle diameter of 180 nm and a weight average molecular weight (Mw) of 15,500 are dispersed is obtained. The glass transition temperature of the styrene-acrylic resin particles is 59° C.

Preparation of Aqueous Phase Liquid (1)

Styrene-Acrylic Resin Particle Dispersion (1): 60 parts

Aqueous Solution of 2% SEROGEN BS-H (manufactured by DKS Co., Ltd.): 200 parts

Ion Exchange Water: 200 parts

The above components are stirred and mixed to obtain an aqueous phase liquid (1).

Preparation of Toner Particles (C-1)

Oil Phase Liquid (1): 300 parts

Isocyanate-Modified Polyester Prepolymer (1): 25 parts

Ketimine Compound (1): 0.5 part

The above components are put into a container and stirred for 2 minutes using a homogenizer (ULTRA TURRAX T50, manufactured by IKA) to obtain an oil phase liquid (1P). Then, 1,000 parts of the aqueous phase liquid (1) is added to the container and stirred for 20 minutes using the homogenizer. Next, this mixture is stirred using a propeller-type stirrer for 48 hours under ordinary pressure (1 atm) at room temperature (25° C.), and the isocyanate-modified polyester prepolymer (1) and the ketimine compound (1) are reacted to form a urea-modified polyester resin, remove the organic solvent, and form a granular material. Next, the granular material is water-washed, dried, and classified, and thus, toner particles (C-1) are obtained.

The volume average particle diameter of the obtained toner particles (C-1) is 6.1 μm as a result of measurement by the above-described method.

The maximum frequent value and the skewness of the distribution of an eccentricity B of the release agent domain are 0.66 and −0.60, respectively, as a result of measurement by the above-described method.

Preparation of Toner

Example 1

With respect to 100 parts of the toner particles (A-1), 1.0 part of titanium oxide particles (average primary particle diameter: 15 nm, JMT-150IB, manufactured by Tayca), 1.5 parts of silica particles (average primary particle diameter: 40 nm, AEROSIL RY50, manufactured by Nippon Aerosil Co., Ltd.), and 0.5 parts of zinc stearate particles (Znst1) are stirred for 10 minutes at a peripheral speed of 40 m/sec using a HENSCHEL mixer.

Next, the mixture is sieved by a wind classifier (e.g., HI-BOLTER 300, manufactured by Shin Tokyo Kikai KK). Thereafter, 0.2 parts of strontium titanate (abrasive particles (a)) is added from an upper part of a collecting tank of a CYCLONE collector, and after 5 minutes, the operation of the CYCLONE collector is stopped to prepare a toner of Example 1.

Comparative Example 1

With respect to 100 parts of the toner particles (A-1), 1.0 part of titanium oxide particles (average primary particle diameter: 15 nm, JMT-150IB, manufactured by Tayca), 1.5 parts of silica particles (average primary particle diameter: 40 nm, AEROSIL RY50, manufactured by Nippon Aerosil Co., Ltd.), 0.5 parts of zinc stearate particles (Znst1), and 0.5 parts of strontium titanate (abrasive particles (a)) are added and stirred for 10 minutes at a peripheral speed of 40 m/sec using a HENSCHEL mixer. Thereafter, the obtained material is sieved using a vibration sieve having openings of 45 μm, and thus a toner of Comparative Example 1 is prepared.

Comparative Example 2

A toner of Comparative Example 2 is prepared in the same manner as in the preparation of the toner of Comparative Example 1, except that the amount of the strontium titanate (abrasive particles (a)) to be added is changed to 0.3 parts.

Comparative Example 3

With respect to 100 parts of the toner particles (A-1), 1.0 part of titanium oxide particles (average primary particle diameter: 15 nm, JMT-150IB, manufactured by Tayca), 1.5 parts of silica particles (average primary particle diameter: 40 nm, AEROSIL RY50, manufactured by Nippon Aerosil Co., Ltd.), and 0.5 parts of strontium titanate (abrasive particles (a)) are added and stirred for 10 minutes at a peripheral speed of 40 m/sec using a HENSCHEL mixer. After the end of the mixing, 0.5 parts of zinc stearate particles (Znst1) is added to the HENSCHEL mixer, and the mixture is stirred for 2 minutes at a peripheral speed of 30 m/sec. Then, the obtained material is sieved using a vibration sieve having openings of 45 μm, and thus a toner of Comparative Example 3 is prepared.

Comparative Example 4

With respect to 100 parts of the toner particles (A-1), 1.0 part of titanium oxide particles (average primary particle diameter: 15 nm, JMT-150IB, manufactured by Tayca), 1.5 parts of silica particles (average primary particle diameter: 40 nm, AEROSIL RY50, manufactured by Nippon Aerosil Co., Ltd.), and 0.5 parts of strontium titanate (abrasive particles (a)) are added and stirred for 10 minutes at a peripheral speed of 40 m/sec using a HENSCHEL mixer. After the end of the mixing, 0.5 parts of zinc stearate particles (Znst1) is added to the HENSCHEL mixer, and the mixture is stirred for 2 minutes at a peripheral speed of 40 m/sec. Then, the obtained material is sieved using a vibration sieve having openings of 45 μm, and thus a toner of Comparative Example 4 is prepared.

Examples 2 to 8

Toners of Examples 2 to 8 are prepared in the same procedure as in Example 1, except that the amount of strontium titanate to be added from the upper part of the collecting tank of the CYCLONE collector and a time until the operation of the CYCLONE collector is stopped are changed. The time until the operation of the CYCLONE collector is stopped is as follows.

Example 2: 0.2 parts, 12 minutes
Example 3: 0.2 parts, 8 minutes
Example 4: 0.45 parts, 5 minutes
Example 5: 0.45 parts, 12 minutes
Example 6: 0.45 parts, 8 minutes
Example 7: 0.2 parts, 1 minutes
Example 8: 0.2 parts, 15 minutes Examples 9 to 21

Toners of Examples 9 to 21 are prepared in the same procedure as in Example 1, except that the type of the toner particles, the type and the content of the fatty acid metal salt particles, and the type and the content of the abrasive particles are changed in accordance with Table 1.

Preparation of Carrier

Ferrite Particles (average particle diameter: 50 μm, volume electric resistance: $3\times10^8$ Ω·cm): 100 parts Toluene: 14 parts Perfluorooctylethyl Acrylate/Dimethylaminoethyl Methacrylate Copolymer (copolymerization ratio: 90:10, Mw=50,000): 1.6 parts Carbon Black (VXC-72, manufactured by Cabot Corporation): 0.12 parts Among the above components, components other than the ferrite particles are dispersed by a stirrer for 10 minutes to prepare a coating forming liquid. This coating forming liquid and the ferrite particles are put into a vacuum deaeration-type kneader, and stirred for 30 minutes at 60° C. Then, the pressure is reduced to remove the toluene, and thus a resin coating is formed on surfaces of the ferrite particles and a carrier is prepared. The volume average particle diameter of the obtained carrier is 51 μm.

Preparation of Developer

With respect to 100 parts of the carrier prepared as described above, 8 parts of a toner obtained in each example is mixed and the obtained mixture is stirred for 20 minutes by a V-blender to obtain a developer.

Evaluation

The prepared developer is contained in a developing machine of a modified apparatus of "DOCUCENTRE COLOR 450" manufactured by Fuji Xerox Co., Ltd., and is kept for 1 day under low temperature and low humidity conditions (temperature: 10° C., humidity: 15% RH). Thereafter, an image having an area coverage (image density) of 50% is continuously output on 100 pieces of paper in a position separated by 3 cm from ends of the paper in a paper supply direction. These images are defined as Image 1.

Next, a full solid image is continuously output on 100 pieces of paper. These images are defined as Image 2.

The same image as Image 1 is continuously output on 100,000 pieces of paper, and the last 100 images are defined as Image 3.

The same image as Image 2 is continuously output on 100 pieces of paper. These images are defined as Image 4.

Evaluation of Image Density Difference in Image Portion of Image 1

Image densities of image portion of Image 1 and Image 3 are measured using an image density meter (X-RITE 938: manufactured by X-rite Inc.) to obtain an image density difference between Image 1 and Image 3 (image density of Image 1-image density of Image 3). The determination is carried out with the following evaluation criteria. G1 to G3 are acceptable levels.

Evaluation Criteria

G1: 0<Image Density Difference Image 1−Image 3≤0.1

G2: 0.1<Image Density Difference Image 1−Image 3≤0.2

G3: 0.2<Image Density Difference Image 1−Image 3≤0.3

G4: 0.3<Image Density Difference Image 1−Image 3≤0.5

G5: 0.5<Image Density Difference Image 1−Image 3

Evaluation of Image Density Difference in Images in which Image is Formed in Non-Image portion of Image 1

Image densities of image portion of Image 2 and Image 4 are measured using an image density meter (X-RITE 938: manufactured by X-rite Inc.) to obtain an image density difference between Image 2 and Image4 (image density of Image 2-image density of Image 4). The determination is carried out with the following evaluation criteria. G1 to G3 are acceptable levels.

Evaluation Criteria

G1: 0<Image Density Difference Image 2−Image 4≤0.1

G2: 0.1<Image Density Difference Image 2−Image 4≤0.2

G3: 0.2<Image Density Difference Image 2−Image 4≤0.3

G4: 0.3<Image Density Difference Image 2−Image 4≤0.5

G5: 0.5<Image Density Difference Image 2−Image 4

TABLE 1

| | | Fatty Acid Metal Salt Particles | | | | Abrasive Particles | | | | | Evaluation | |
|---|---|---|---|---|---|---|---|---|---|---|---|---|
| | Toner Particle No. | No. | Content (C) Parts | Isolation Amount (A) mg | Isolation Rate % | No. | Content (D) Parts | Isolation Amount (B) mg | Isolation Amount Ratio B/A | Total Amount Ratio D/C | Density Difference in Image portion | Density Difference in Non-Image Part |
| Example 1 | A-1 | Znst1 | 0.5 | 8.1 | 54 | a | 0.2 | 4.8 | 0.59 | 0.40 | G1 | G2 |
| Example 2 | A-1 | Znst1 | 0.5 | 6.8 | 45 | a | 0.2 | 3.0 | 0.44 | 0.40 | G1 | G2 |
| Example 3 | A-1 | Znst1 | 0.5 | 7.5 | 50 | a | 0.2 | 3.9 | 0.52 | 0.40 | G1 | G2 |
| Example 4 | A-1 | Znst1 | 0.5 | 6.0 | 40 | a | 0.45 | 9.9 | 1.65 | 0.90 | G1 | G3 |
| Example 5 | A-1 | Znst1 | 0.5 | 4.5 | 30 | a | 0.45 | 6.8 | 1.50 | 0.90 | G3 | G3 |
| Example 6 | A-1 | Znst1 | 0.5 | 5.3 | 35 | a | 0.45 | 8.8 | 1.67 | 0.90 | G2 | G3 |
| Example 7 | A-1 | Znst1 | 0.5 | 13.5 | 90 | a | 0.2 | 5.7 | 0.42 | 0.40 | G1 | G3 |
| Example 8 | A-1 | Znst1 | 0.5 | 5.1 | 34 | a | 0.2 | 2.4 | 0.47 | 0.40 | G3 | G1 |
| Example 9 | A-1 | Znst1 | 0.8 | 15.4 | 68 | a | 0.2 | 4.8 | 0.31 | 0.25 | G1 | G3 |
| Example 10 | A-1 | Znst1 | 0.5 | 9.3 | 62 | a | 0.37 | 7.2 | 0.77 | 0.74 | G1 | G1 |
| Example 11 | A-1 | Znst1 | 0.5 | 5.4 | 36 | a | 0.5 | 10.8 | 2.00 | 1.00 | G2 | G3 |
| Example 12 | A-1 | Znst1 | 0.7 | 12.2 | 58 | a | 0.15 | 3.6 | 0.30 | 0.21 | G2 | G3 |
| Example 13 | A-1 | Znst1 | 0.5 | 6.8 | 45 | b | 0.2 | 4.7 | 0.70 | 0.40 | G1 | G2 |
| Example 14 | A-1 | Znst1 | 0.5 | 10.5 | 70 | c | 0.2 | 4.7 | 0.45 | 0.40 | G2 | G2 |
| Example 15 | A-1 | Znst1 | 0.5 | 7.2 | 48 | d | 0.2 | 4.9 | 0.68 | 0.40 | G1 | G2 |
| Example 16 | A-1 | Znst1 | 0.5 | 7.5 | 50 | e | 0.2 | 4.7 | 0.63 | 0.40 | G1 | G2 |
| Example 17 | A-1 | Znst1 | 0.5 | 7.8 | 52 | a | 0.2 | 4.8 | 0.62 | 0.40 | G1 | G2 |
| Example 18 | B-1 | Znst1 | 0.5 | 6.0 | 40 | a | 0.2 | 4.7 | 0.79 | 0.40 | G1 | G1 |
| Example 19 | B-2 | Znst1 | 0.5 | 6.0 | 40 | a | 0.2 | 4.7 | 0.78 | 0.40 | G1 | G1 |
| Example 20 | B-3 | Znst1 | 0.5 | 6.0 | 40 | a | 0.2 | 4.7 | 0.79 | 0.40 | G1 | G1 |
| Example 21 | C-1 | Znst1 | 0.5 | 9.0 | 60 | a | 0.2 | 4.5 | 0.50 | 0.40 | G1 | G2 |
| Comparative Example 1 | A-1 | Znst1 | 0.5 | 2.3 | 15 | a | 0.45 | 7.4 | 3.30 | 0.90 | G5 | G5 |
| Comparative Example 2 | A-1 | Znst1 | 0.5 | 2.3 | 15 | a | 0.3 | 5.0 | 2.20 | 0.60 | G5 | G4 |
| Comparative Example 3 | A-1 | Znst1 | 0.5 | 14.9 | 99 | a | 0.45 | 3.8 | 0.25 | 0.90 | G4 | G4 |
| Comparative Example 4 | A-1 | Znst1 | 0.5 | 13.1 | 87 | a | 0.2 | 2.3 | 0.17 | 0.40 | G3 | G5 |

In Table 1, "Inst" indicates "zinc stearate", and "Znla" indicates "zinc laurate".

"B/A" indicates a ratio of "an isolation amount B of the abrasive particles to an isolation amount A of the fatty acid metal salt particles".

"D/C" indicates a ratio of "a total amount D of the abrasive particles to a total amount C of the fatty acid metal salt particles".

From the above-described results, it is found that the image evaluation results are better in the examples than in the comparative examples.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrostatic charge image developing toner comprising:

toner particles containing a binder resin and a release agent; and an external additive containing fatty acid metal salt particles and abrasive particles, wherein a ratio (B/A) of an isolation amount B of the abrasive particles isolated from the toner particles after an ultrasonic isolation treatment to an isolation amount A of the fatty acid metal salt particles isolated from the toner particles after the ultrasonic isolation treatment is from 0.3 to 2.0, the toner particles have a sea and island structure, wherein a sea portion contains the binder resin and an island portion contains the release agent, a maximum frequent value in distribution of an eccentricity B of the island portion containing the release agent is in a range of from 0.71 to 1.00, and a skewness in the distribution of the eccentricity B is in a range of from −1.10 to −0.50, the eccentricity B being represented by the following expression (1):

$$\text{Eccentricity } B = 2d/D \quad (1)$$

wherein D indicates an equivalent circle diameter (μm) of the toner particles in an observation of a cross-section of the toner particles, and d indicates a distance (μm) from a centroid of the toner particles to a centroid of the island portion containing the release agent in the observation of a cross-section of the toner particles.

2. The electrostatic charge image developing toner according to claim 1, wherein a ratio (D/C) of a total amount D of the abrasive particles to a total amount C of the fatty acid metal salt particles is from 0.25 to 0.9.

3. The electrostatic charge image developing toner according to claim 1, wherein a ratio ($D_a/D_b$) of the volume average particle diameter $D_a$ of the toner particles to the number average particle diameter $D_b$ of the fatty acid metal salt particles is from 2.5 to 7.

4. The electrostatic charge image developing toner according to claim 1, wherein a ratio ($D_c/D_b$) of the number average particle diameter $D_c$ of the abrasive particles to the number average particle diameter $D_b$ of the fatty acid metal salt particles is from 1.5 to 6.0.

5. The electrostatic charge image developing toner according to claim 1, wherein an isolation amount A of the fatty acid metal salt particles is from 3.0 mg to 20 mg, and an isolation amount B of the abrasive particles is from 3.0 mg to 20 mg.

6. The electrostatic charge image developing toner according to claim 1, wherein the toner particles contain a polyester resin as the binder resin.

7. The electrostatic charge image developing toner according to claim 6, wherein a glass transition temperature (Tg) of the polyester resin is from 50° C. to 65° C.

8. The electrostatic charge image developing toner according to claim 1, wherein the toner particles contain a urea-modified polyester resin as the binder resin.

9. The electrostatic charge image developing toner according to claim 8, wherein a glass transition temperature of the urea-modified polyester resin is from 45° C. to 60° C.

10. The electrostatic charge image developing toner according to claim 1, wherein an average circularity of the toner particles is from 0.90 to 0.97.

11. The electrostatic charge image developing toner according to claim 1, wherein the abrasive particles are strontium titanate particles.

12. The electrostatic charge image developing toner according to claim 1, wherein the fatty acid metal salt particles are zinc stearate particles.

13. The electrostatic charge image developing toner according to claim 1, wherein an isolation rate of an amount of fatty acid metal salt particles isolated from the toner particles after an ultrasonic isolation treatment with respect to an amount of fatty acid metal salt particles isolated from the toner particles before the ultrasonic isolation treatment is from 35% to less than 90%.

14. An electrostatic charge image developer comprising:

the electrostatic charge image developing toner according to claim 1.

15. A toner cartridge comprising:

a container that contains the electrostatic charge image developing toner according to claim 1, wherein the toner cartridge is detachable from an image forming apparatus.

16. An electrostatic charge image developing toner comprising:

toner particles containing a binder resin and a release agent; and an external additive containing fatty acid metal salt particles and abrasive particles, wherein the toner particles have a sea and island structure, wherein a sea portion contains the binder resin and an island portion contains the release agent, a maximum frequent value in distribution of an eccentricity B of the island portion containing the release agent is in a range of from 0.71 to 1.00, and a skewness in the distribution of the eccentricity B is in a range of from −1.10 to −0.50, the eccentricity B being represented by the following expression (1):

$$\text{Eccentricity } B = 2d/D \quad (1)$$

wherein D indicates an equivalent circle diameter (μm) of the toner particles in an observation of a cross-section of the toner particles, and d indicates a distance (μm) from a centroid of the toner particles to a centroid of the island portion containing the release agent in the observation of a cross-section of the toner particles.

17. An electrostatic charge image developer comprising:

the electrostatic charge image developing toner according to claim 16.

18. A toner cartridge comprising:

a container that contains the electrostatic charge image developing toner according to claim 16, wherein the toner cartridge is detachable from an image forming apparatus.

* * * * *